United States Patent [19]

Myochin et al.

[11] Patent Number: 5,018,045

[45] Date of Patent: May 21, 1991

[54] CORONA DISCHARGER FOR USE IN ELECTROPHOTOGRAPHIC COPYING MACHINE

[75] Inventors: Hisashi Myochin; Yoshinori Inoue; Hitoshi Saito; Narutaka Yoshida, all of Osaka, Japan

[73] Assignee: Minolta Camera Kabushiki Kaisha, Osaka, Japan

[21] Appl. No.: 507,748

[22] Filed: Apr. 12, 1990

[30] Foreign Application Priority Data

Apr. 14, 1989 [JP] Japan ..... 1-96088
Jul. 18, 1989 [JP] Japan ..... 1-84825[U]

[51] Int. Cl.[5] ..... G03G 15/02; H01T 19/00

[52] U.S. Cl. ..... 361/229; 250/324; 355/215; 355/221

[58] Field of Search ..... 355/215, 221–223, 355/225; 250/324–326; 361/229

[56] References Cited

U.S. PATENT DOCUMENTS

| | | | |
|---|---|---|---|
| 3,777,158 | 12/1973 | Kamogawa et al. | 250/324 |
| 4,021,709 | 5/1977 | Kamogawa et al. | 361/229 |
| 4,053,770 | 10/1977 | Tanaka et al. | 250/324 |
| 4,112,299 | 9/1978 | Davis | 250/326 |

FOREIGN PATENT DOCUMENTS

| | | | |
|---|---|---|---|
| 49-9250 | 1/1974 | Japan . | |
| 50-25236 | 3/1975 | Japan . | |
| 55-113066 | 9/1980 | Japan | 355/221 |
| 58-166365 | 10/1983 | Japan | 355/221 |
| 64-82059 | 3/1989 | Japan . | |

*Primary Examiner*—Joan H. Pendegrass
*Attorney, Agent, or Firm*—Burns, Doane, Swecker & Mathis

[57] ABSTRACT

There is disclosed a corona discharger comprising a discharge wire for producing a corona discharge, a voltage source for applying a predetermined voltage to the discharge wire, an electrically conductive back plate being provided on the opposite side of the discharge wire to a member to be electrified, and an electrically conductive side plate being provided close to the member to be electrified. In the corona discharger, an opening for discharging ozone produced by said corona discharge is formed between said side plate and said back plate, and respective electric potentials of the side plate and the back plate are set so that a difference between respective electric potentials of the side plate and the discharge wire becomes lower than a difference between respective electric potentials of the back plate and the discharge wire.

23 Claims, 15 Drawing Sheets

CORONA DISCHARGER FOR USE IN ELECTROPHOTOGRAPHIC COPYING MACHINE

BACKGROUND OF THE INVENTION

1. Field of the Invention

The present invention relates to a corona discharger, more particularly, to a corona discharger which can be used as a corona discharger, a transfer charger, or a charge eraser, for use in an electrophotographic copying machine.

2. Description of Related Art

Corona dischargers have been used for use in, for example, an electrophotographic copying machine, as a charger for uniformly electrifying a photoconductive drum, a transfer charger for transferring a visible toner image formed on the photoconductive drum onto a piece of copying paper, or a charge eraser for removing the charge on the photoconductive drum.

A conventional corona discharger comprises a discharge wire to which a high voltage is applied, and a shielding plate for stabilizing the corona discharge produced around the discharge wire. For example, when the corona discharger of this type is used as a corona charger, the discharge wire is provided apart from the surface of the photoconductive drum by a predetermined constant distance so that the axis thereof becomes parallel thereto. If a high voltage is applied between the discharge wire and the photoconductive drum in this state, the corona discharge is started in the vicinity of the discharge wire, and a current due to the produced ions flows between the discharge wire and the surface of the photoconductive drum. Then, the charge is stored on the surface of the photoconductive drum.

Accompanying with the corona discharge, the ozone is produced. Since the ozone has a property of deteriorating the photoconductive drum by acting the surface thereof, it is necessary to prevent the produced ozone from harmfully influencing the photoconductive drum.

In a corona discharger proposed in the U.S. Pat. No. 3,777,158, a distance between a discharge wire and a shielding plate is set so as to be smaller than a distance between the discharge wire and a photoconductive drum, and then, more larger corona current flows onto the shielding plate than that flowing onto the photoconductive drum. As a result, an air stream induced by the produced ion stream flows toward the shielding plate, and then, the ozone produced by the corona discharge is discharged through an outlet formed in a shielding plate to the side opposite of the discharge wire to the photoconductive drum.

However, in the corona discharger proposed in the above U.S. Patent, since almost all the current caused by the corona discharge flows onto the shielding plate, much power is consumed uselessly and uneconomically. In order to obtain a high charging ability, it is necessary to provide a higher voltage source having a higher output power, and the cost of manufacturing the corona charger increases. In addition to this, since the whole discharge amount of the corona discharge becomes relatively large, much ozone is produced. Therefore, even though the produced ozone is efficiently discharged, harmful influence to human body can not be neglected.

In order to prevent a large current from flowing onto the shielding plate, there has been proposed a corona discharge constituted so that almost all the current flows between a discharge wire and a photoconductive drum by applying to the shielding plate a bias voltage having the same polarity as that of a voltage to be applied to the discharge wire. In this case, the voltage to be applied to the discharge wire is relatively low. However, since the ion stream caused during the corona discharge flows from the discharge wire toward the photoconductive drum, an air stream induced by the produced ion stream flows from the vicinity of the discharge wire toward the surface of the photoconductive drum. Then, almost all the ozone produced by the corona discharge is transported toward the surface of the photoconductive drum by the aforementioned air stream, resulting in deterioration of the photoconductive drum.

Furthermore, there has been a corona discharger comprising an electrically insulating plate on the inner surface of the shielding plate so as not to flow the ion current onto the shielding plate. However, the corona discharger of this type has the following problems. In the corona discharger, the insulating plate is electrified, and an alien substance and a dust adhere to the insulating plate while the corona discharge is stopped, resulting in ununiform electrifying during the corona discharge. Further, since the electric field induced around the discharge wire varies depending on the electrifying amount of the insulating plate, the corona discharger has such a disadvantage that the corona discharge becomes unstable.

Furthermore, there has been proposed in the Japanese patent laid open publication (JP-A) No. 64-82059 published on Mar. 28, 1989, a charger wherein there is set a relatively long distance between a side plate of a shielding member and a discharge wire in order to decrease the current flowing from the discharge wire to the side plate of the shielding member. The charger is capable of decreasing useless corona discharge, however, there is such a problem that the charger is scaled up since it is necessary to provide the side plate of the shielding member so as to be apart from the discharge wire by a predetermined distance.

SUMMARY OF THE INVENTION

An essential object of the present invention is to provide a corona discharger improved as compared with the conventional corona dischargers.

Another object of the present invention is to provide a miniaturized corona discharger which is capable of producing a corona discharge more stably.

A further object of the present invention is to provide a corona discharger which is capable of producing a corona discharge with smaller power consumption without harmfully influencing to a photoconductive drum to be electrified.

A still further object of the present invention is to provide a corona discharger which is capable of producing a corona discharge more safely.

A still more further object of the present invention is to provide a corona discharger which is capable of producing a corona discharge making an air stream induced by the produced ions flow so as to leave a photoconductive drum to be electrified.

In order to accomplish the above objects, according to one aspect of the present invention, there is provided a corona discharger comprising:

a discharge member for producing a corona discharge;

means for applying a predetermined voltage to said discharge member;

an electrically conductive back plate being provided on the opposite side of said discharge member to a member to be electrified;

an electrically conductive side plate being provided close to said member to be electrified;

an opening for discharging ozone produced by said corona discharge, said opening being formed between said side plate and said back plate; and means for setting respective electric potentials of said side plate and said back plate so that a difference between respective electric potentials of said side plate and said discharge member becomes lower than a difference between respective electric potentials of said back plate and said discharge member.

According to another aspect of the present invention, there is provided a corona discharger comprising:

a discharge member for producing a corona discharge;

means for applying a predetermined voltage to said discharge member;

a shielding member being provided so as to surround said discharge member, said shielding member including at least two portions which are electrically insulated from each other, said shielding member having a first opening which is formed so as to oppose to said member to be electrified, and a second opening for discharging ozone produced by said corona discharge which is formed between said two portions thereof; and electric potential setting means for setting respective electric potentials of said two portions of said shielding member so as to be different from each other.

According to a further aspect of the present invention, there is provided a corona discharger comprising:

discharge member for producing a corona discharge;

means for applying a predetermined voltage to said discharge member;

shielding member being provided so as to surround said discharge member, said shielding member having a first opening for said corona discharge and a second opening for discharging a gas produced within said shielding member; and electric potential setting means for setting electric potentials of respective portions of said shielding means so that said electric potentials of respective portions thereof are different from each other.

According to a more further aspect of the present invention, there is provided a corona discharger comprising:

a discharge member for producing a corona discharge;

means for applying a predetermined voltage to said discharge member;

an electrically conductive back plate being located on the opposite side of said discharge member to a member to be electrified by said discharge member, an opening for discharging ozone being formed in said back plate;

an electrically conductive side plate being located at a position closer to said member to be electrified than said back plate, said side plate being electrically insulated from said back plate; and means for setting predetermined electric potentials of said side plate and said back plate so that a difference between respective electric potentials of said side plate and said discharge member becomes smaller than a difference between respective electric potentials of said back plate and said discharge member.

According to a still more further aspect of the present invention, there is provided a corona discharger comprising:

a discharge member for producing a corona discharge;

means for applying a predetermined voltage to said discharge member;

a shielding member being provided so as to surround said discharge member, said shielding member having a first opening being formed so as to be oppose to a member to be electrified and a second opening for discharging an inner gas produced within said shielding member, said shielding member including an electrically conductive back plate being located on the opposite side of said discharge member to said member to be electrified, and an electrically conductive side plate being electrically insulated from said back plate and located close to said member to be electrified; and means for setting predetermined electric potentials of said side plate and said back plate so that a difference between respective electric potentials of said side plate and said discharge member becomes smaller than a difference between respective electric potentials of said back plate and said discharge member.

According to a more still further aspect of the present invention, there is provided a corona discharger comprising:

a discharge member for producing a corona discharge;

means for applying a predetermined voltage to said discharge member;

a shielding member being provided so as to surround said discharge member, said shielding member having a first opening for said corona discharge and a second opening for discharging an inner gas within said shielding member, said shielding member comprising a first member close to said first opening and a second member being located at a position farther from said first opening than said first member; and means for setting predetermined electric potentials of said side plate and said back plate so that a difference between respective electric potentials of said first member and said discharge member becomes smaller than a difference between respective electric potentials of said second member and said discharge member.

According to a more still more further aspect of the present invention, there is provided a corona discharger comprising:

a corona discharge wire for producing a corona discharge;

a first shielding member having an opening for said corona discharge and an opening for discharging produced ozone, said first shielding member being provided so as to surround said corona discharge wire;

an electrically insulating member being mounted across said opening for discharging the produced ozone and being fixed at said first shielding member;

a second shielding member being fixed at said insulating member; and electric potential setting means for setting respective electric potentials of said first shielding member and said second shielding member so as to be different from each other.

BRIEF DESCRIPTION OF THE DRAWINGS

These and other objects and features of the present invention will become clear from the following description taken in conjunction with the preferred embodiments thereof with reference to the accompanying drawings, in which:

FIG. 21*b* is a schematic cross sectional view taken on line E—E' of FIG. 21*a.

DETAILED DESCRIPTION OF THE PREFERRED EMBODIMENTS

Preferred embodiments according to the present invention will be described below with reference to the attached drawings.

Figure 1:
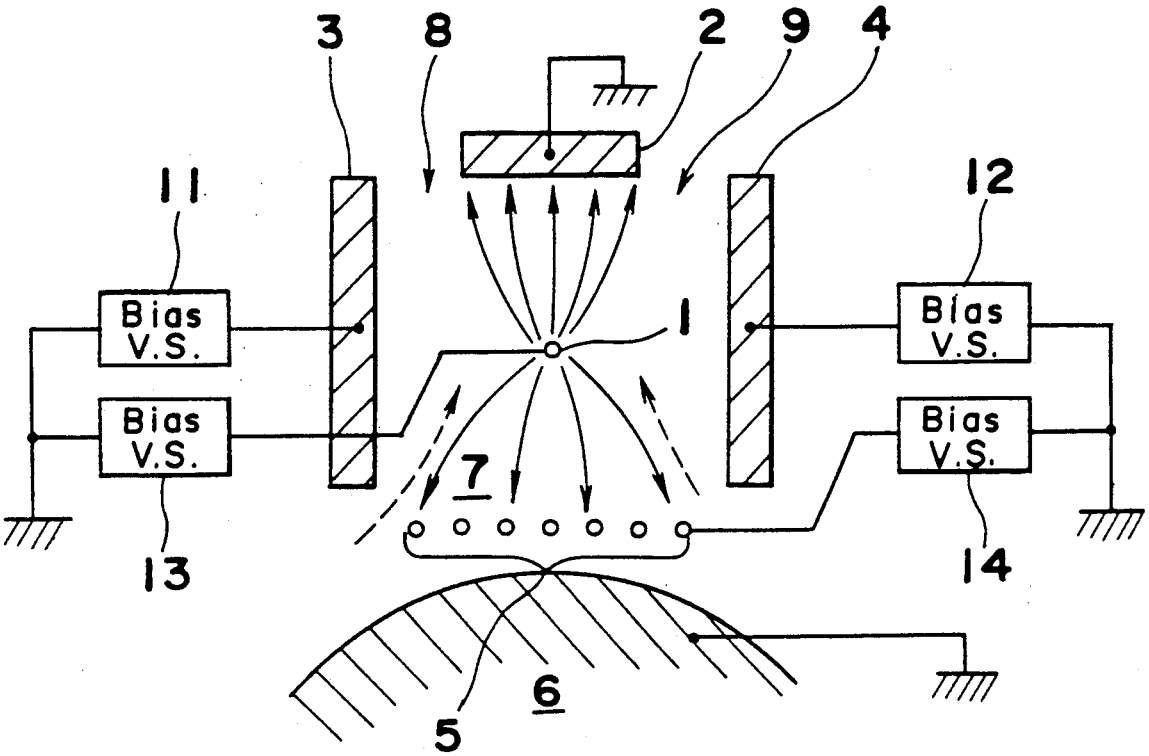
FIG. 1 is schematic cross sectional view taken on line A—A' of FIG. 2 showing a corona discharger of a first preferred embodiment according to the present invention.
Figure 2:
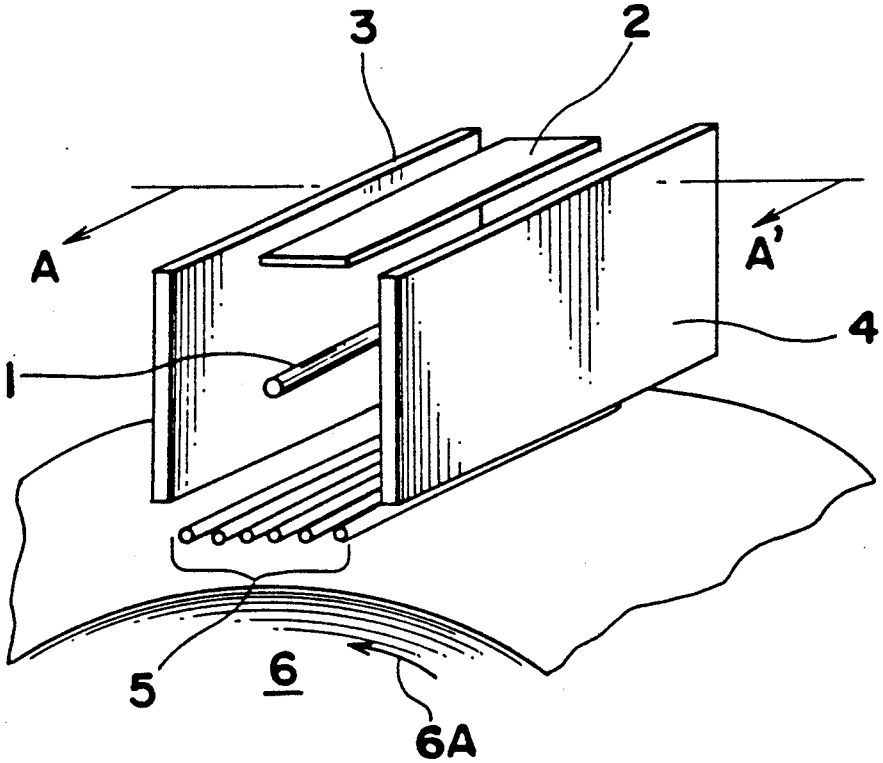
FIG. 2 is a perspective view showing the corona discharger shown FIG. 1.

FIGS. 1 and 2 show a scolotron type corona discharger of a first preferred embodiment according to the present invention.

Referring to FIGS. 1 and 2, the scolotron type corona charger of the first preferred embodiment is provided for electrifying a surface of a photoconductive drum 6 which is provided to execute the electrophotographic process, and comprises an electrically conductive corona discharge wire 1, electrically conductive shielding plates for stabilizing a corona discharge which are provided so as to surround the corona discharge wire 1, and an electrically conductive screen grid 5 for controlling an ion stream which is provided at a position between the photoconductive drum 6 and the discharger wire 1 which is closer to the photoconductive drum 6 than the discharge wire 1 so as to oppose to the surface of the photoconductive drum 6. The shielding plates are composed of a back plate 2 provided on the opposite side of the discharge wire 1 to the photoconductive drum 6 so as to oppose to the surface of the photoconductive drum 6, and a pair of side plates 3 and 4 provided between the back plate 2 and the photoconductive drum 6 so as to oppose to each other.

On the surface of the photoconductive drum 6, a photoconductive layer is formed, and the photoconductive drum 6 is electrically grounded. The back plate 2 is electrically grounded, and the side plates 3 and 4 are connected to bias voltage sources 11 and 12, respectively. Further, the corona discharge wire 1 is connected to a high voltage source 13 in order to produce a strong electric field for the corona discharge. Furthermore, the screen grid 5 is connected to a grid voltage source 14 in order to induce approximately the same electric potential as an electric potential of the photoconductive layer of the photoconductive drum 6. It is to be noted that the voltage sources 13 and 14 are omitted in the drawings of the following figures for simplifying them.

In FIGS. 1 and 2, arrows of real line denote lines of electric force, and arrows of dotted line denote an air stream induced by the produced ions.

When the corona discharger is used as a charger, the photoconductive layer of the photoconductive drum 6 which is rotated in a direction as indicated by an arrow 6A as shown in FIG. 2 is illuminated previously by an eraser lamp (not shown) so as to receive an action of the corona discharge on the condition of no remaining charge thereon, resulting in uniform electrifying of the photoconductive layer thereof.

Upon the corona discharge, a suitable bias voltage having the same polarity as that of the ion stream is applied to the side plates 3 and 4, so that a difference between the electric potential of the discharge wire 1 and the electric potential of respective side plates 3 and 4 can be set to be smaller than a difference between respective electric potentials of the discharge wire 1 and the back plate 2, an electric field induced between the discharge wire 1 and the back plate 2 can be set to be relatively strong, and an electric filed induced between the discharge wire 1 and the respective side plates 3 and 4 can be set to be relatively weak. Therefore, the ions produced in the vicinity of the discharge wire 1 are controlled so that the ion stream thereof flows toward mainly the back plate 2 and the photoconductive drum 6.

In the corona discharger having the composition shown in FIGS. 1 and 2, there is hardly produced ion stream for flowing toward the side plates 3 and 4 which are one portions of the shielding plate. Therefore, the current flowed onto the shielding plates 2 to 4 can be decreased thereby. Further, since the whole discharge amount can be decreased, the producing amount of ozone can be decreased, and the power consumption can be decreased. On the other hand, the corona discharge is stabilized by the electric field induced between the back plate 2 which is one portion of the shielding plates and the discharge wire 1, and also the ion stream flowing from the discharge wire 1 toward the back plate 2 can prevent a relatively strong air stream induced by the ions which flows toward the surface of the photoconductive drum 6 from inducing.

Furthermore, the distance between the discharge wire 1 and the back plate 2 is set to be smaller than the distance between the discharge wire 1 and the photoconductive drum 6, and the electric field applied between the discharge wire 1 and the back plate 2 is set to be larger than the electric field applied between the discharge wire 1 and the photoconductive drum 6. As a result, the ion stream flowing toward the back plate 2 can be controlled that the flow amount of the ion stream thereof becomes larger than that flowing toward the photoconductive drum 6.

Namely, when the flow amount of the ion stream flowing toward the back plate 2 is set to be larger than that flowing toward the photoconductive drum 6, the air stream induced by the ions is produced so as to flow from the side of the photoconductive drum 6 toward the back plate 2 as indicated by the arrows of dotted lines of FIG. 1, and then, the air stream thereof is discharged to the outside of the corona discharger through outlets 8 and 9 formed in respective portions between the back plate 2 and respective side plate 3 and 4. Then, the ozone produced accompanying with the corona discharge can be prevented from directly acting the photoconductive drum 6, and the damage caused to the photoconductive drum 6 can be lowered.

It is to be noted that, even though the gap between the discharge wire 1 and the back plate 2 and the gap between the discharge wire 1 and the photoconductive drum 6 are set so as to be approximately the same, if the surface of the photoconductive drum 6 is electrified even slightly, the difference between respective electric potentials of the discharge wire 1 and the photoconductive drum 6 decreases, resulting in decrease in the air stream induced by the ions which flows from the discharge wire 1 toward the surface of the photoconductive drum 6. Therefore, as the surface of the photoconductive drum 6 is electrified, the air stream induced by the ions is produced which flows from the side of the photoconductive drum 6 toward the outlets 8 and 9.

Results of an electric field analysis of a corona discharger having substantially the same composition of the corona discharger shown in FIGS. 1 and 2 will be described below with reference to FIG. 3.

Figure 3:
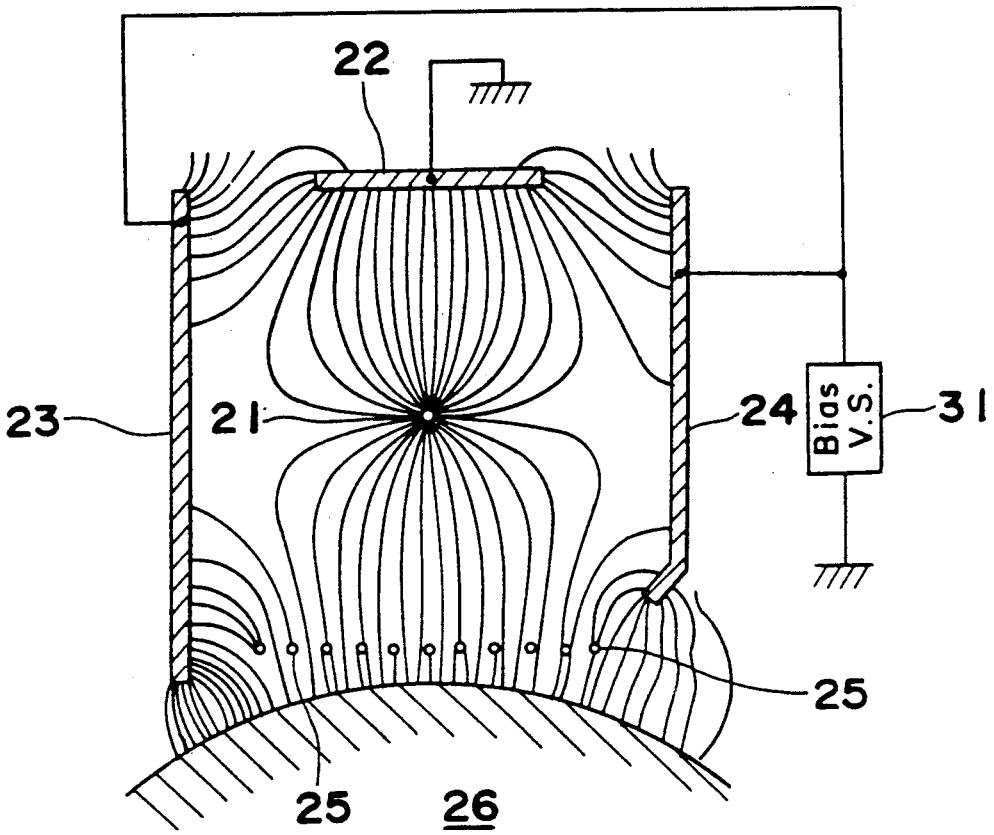
FIG. 3 is a schematic cross sectional view of the corona discharger shown in FIG. 1 showing lines of electric force which are obtained by a result of an electric field analysis.

Referring to FIG. 3, there are provided an electrically conductive corona discharge wire 21, an electrically conductive back plate 22 which is electrically grounded, a pair of electrically conductive side plates 23 and 24, and an electrically conductive screen grid 25 for controlling an air stream induced by the produced ions, and a photoconductive drum 26 on which a photoconductive layer is formed. A voltage of −5.5 KV is applied to the corona discharge wire 21, and a voltage of −2 KV is applied to a pair of side plates 23 and 24 by a common bias voltage source 31. Further, a grid voltage of −0.67 KV is applied to the screen grid 25. It is to be noted that the photoconductive drum 6 is set in such a state that there is no remaining charge thereon by illuminating a photoconductive layer of the photoconductive drum 26 by an eraser lamp.

In FIG. 3, there are represented lines of electric force which are obtained by the electric field analysis of the corona discharge in this state.

Referring to FIG. 3, there are formed the lines of electric force so as to connect the discharge wire 21 to the back plate 22 and the photoconductive drum 26 through the screen grid 25, to connect respective side plates 23 and 24 to the photoconductive drum 26, and to connect the side plates 23 and 24 to the back plate 22. The lines of electric force are distributed depending on the shape and the electric potential of each of the members 21 to 26, and the arrangement of the members 21 to 26. High density of the lines of electric force means a strong electric field in a direction of a tangent line to the lines of electric force in an area within the corona discharger. The ions produced by the corona discharge flows in the direction of the tangent line to the lines of electric force. Therefore, the ion stream flows toward the photoconductive drum 26 and toward the back plate 22, and does not flow toward the side plates 23 and 24. Due to this, since useless current hardly flows toward the side plates 23 and 24, the power consumption can be decreased.

Further, since the electric potential of the back plate 22 is kept to be zero V, the corona discharge can be stabilized by a relative strong electric field induced between the discharge wire 1 and the back plate 22. Furthermore, since the number of the lines of electric force formed toward the back plate 22 is larger than that formed toward the photoconductive drum 26, the air stream induced by the produced ions flows toward the back plate 22. Due to this, since the ozone produced by the corona discharge is flowed by the air stream toward the back plate 22 and not toward the photoconductive drum 26, the damage caused to the photoconductive drum 26 can be lowered.

When the corona discharger is used as a corona charger practically, a portion of the surface of the photoconductive drum 26 approaches the corona charger in such a state that there is no remaining charge on the photoconductive drum 26 by the light illumination, and moves storing the charge on the surface thereof by means of the ion stream produced within the corona charger. Thereafter, when the portion of the surface of the photoconductive drum 26 leaves the corona charger, it is electrified up to substantially the same electric potential as that of the screen grid 25. Therefore, as the surface of the photoconductive drum 26 is electrified, the number of the lines of electric force decreases. Then, since the air stream induced by the produced ions flows in such a direction that the air stream leaves the photoconductive drum 26, the damage caused to the photoconductive drum 26 can be further lowered.

Figure 4:
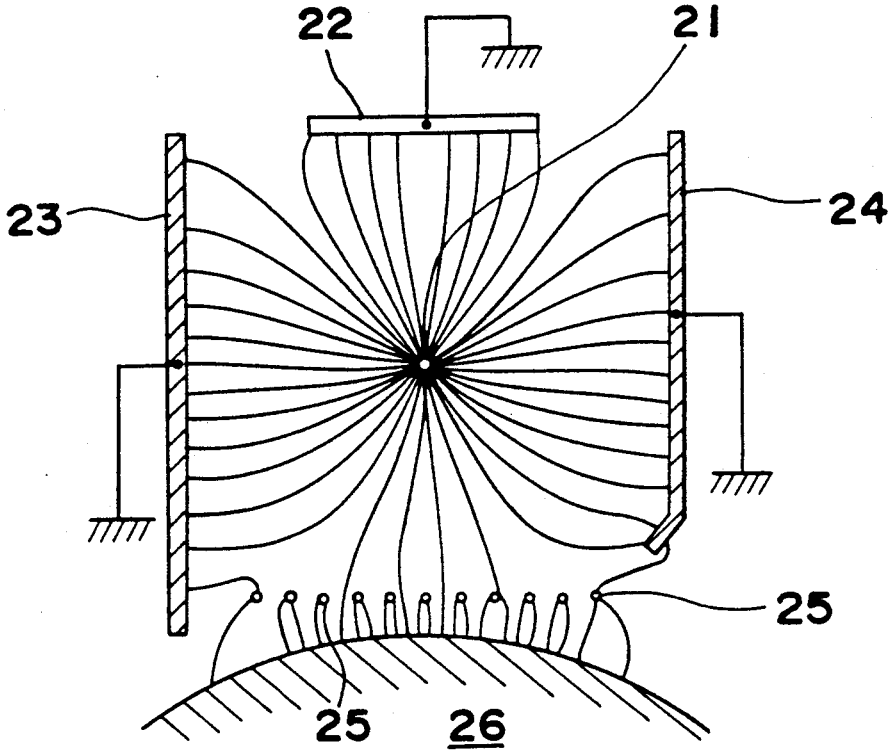
Fig. 4 PRIOR ART
FIG. 4 is a schematic cross sectional view of a conventional corona discharger showing lines of electric force which are obtained by a result of an electric field analysis.

FIG. 4 shows a result of an electric field analysis of a conventional corona discharger comprising the shielding plates 22 to 24 which are electrically grounded, and the other members 21, 25 and 26 provided in a manner similar to that of the corona discharger shown in FIG. 3.

As is apparent from FIG. 4, the produced ion stream flows onto the photoconductive drum 6 and the shielding plates 22 to 24 which are provided so as to surround the discharge wire 21, and a power larger than that of the present preferred embodiment is consumed in the conventional corona discharger shown in FIG. 4.

Figure 5:
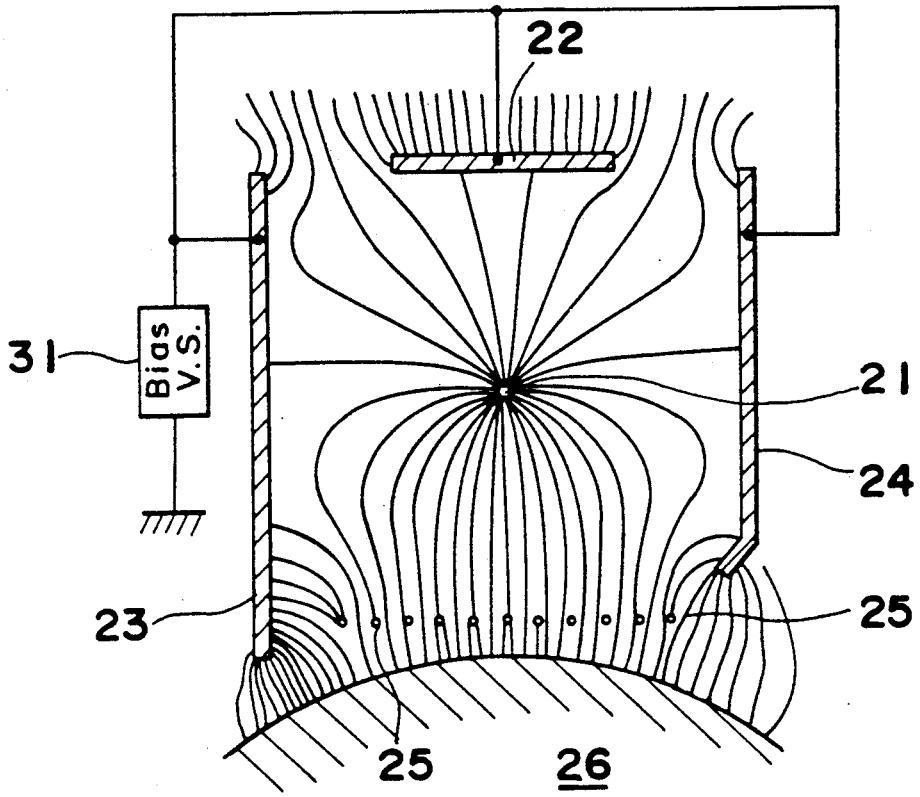
Fig. 5 PRIOR ART
FIG. 5 is a schematic cross sectional view of a corona discharger of a comparative example showing lines of electric force which are obtained by a result of an electric field analysis.

FIG. 5 shows a result of an electric field analysis of a corona discharger of a comparative example which comprises the shielding plates 22 to 24 to which a bias voltage of −2 KV is applied, and the other members 21, 25 and 26 provided in a manner similar to that of the corona discharger shown in FIG. 3.

As is apparent from FIG. 5, when the bias voltage having the same polarity as that of the discharge wire 21 is applied to all the shielding plates 22 to 24, the electric fields induced between the discharge wire 21 and respective shielding plates 22 to 24 are decreased, the air stream induced by the produced ions flows toward almost all the photoconductive drum 26. Then, the damage caused to the photoconductive drum 26 becomes relatively large. Further, since the electric field applied between the discharge wire 21 and respective shielding plates 22 to 24 are relatively weak, it is difficult to stabilize the corona discharge.

Figure 6:
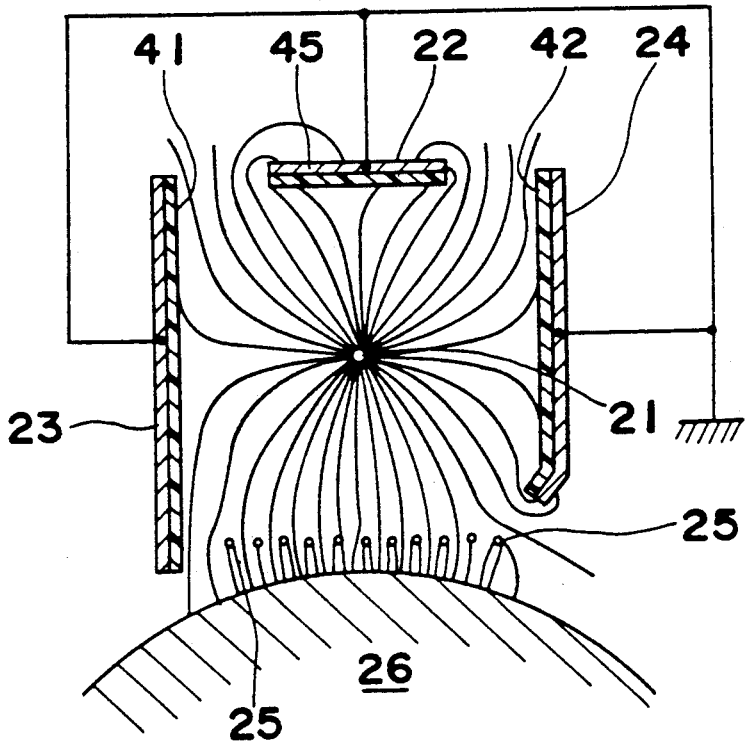
Fig. 6 PRIOR ART
FIG. 6 is a schematic cross sectional view of a corona discharger of another comparative example showing lines of electric force which are obtained by a result of an electric field analysis.

FIG. 6 shows a result of an electric field analysis of a corona discharger of another comparative example comprising the electrically grounded shielding plates 22 to 24 on the whole inner surfaces of which electrically insulating plates 41, 42 and 45 of a Mylar® plate of polyethyleneterephthalate are bonded respectively, and the other members 21, 25 and 26 provided in a manner similar to that of the corona discharger shown in FIG. 4.

In this case, similarly to the comparative example shown in FIG. 5, the flow amount of the ion stream which flows toward the shielding plates 22 to 24 can be decreased, however, the air stream induced by the produced ions flows toward the photoconductive drum 26. Therefore, the damage to the photoconductive drum 26 due to the air stream induced by the ions can not be decreased. Further, since any corona discharge is not produced between the discharge wire 21 and respective shielding plates 22 to 24, the corona discharge can not be stabilized. Furthermore, since the charge is stored easily on the surface of the insulating plates 41, 42 and 45, a dust and an alien substance may adhere thereto, resulting in ununiform charging thereon.

As described above, in the first preferred embodiment shown in FIG. 3, there is caused a difference between the electric potential of the back plate 22 and the electric potential of each of the plates 23 and 24, and the ion stream is flowed onto the back plates 22. On the other hand, the ion stream can be prevented from flowing onto the side plates 23 and 24. The other means can be used in order to make the electric field in the vicinity of the openings for discharging relatively weak and to make the electric field in the vicinity of the openings for discharging the produced ozone relatively strong.

Figure 7:
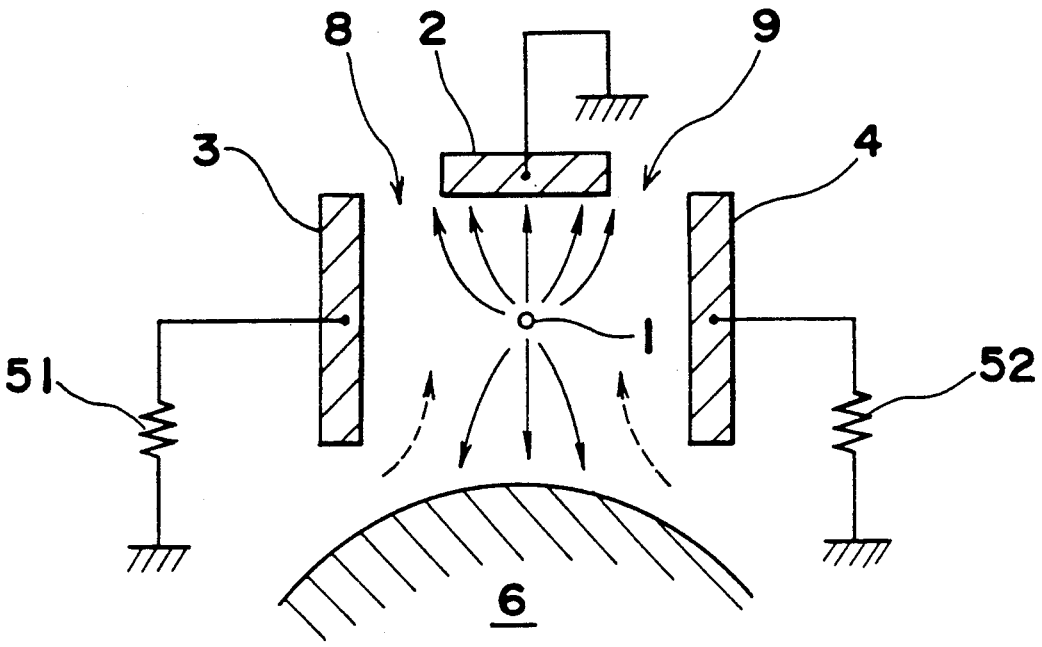
FIG. 7 is a schematic cross sectional view showing a corona discharger of a second preferred embodiment according to the present invention.

FIG. 7 shows a corona discharger of a second preferred embodiment according to the present invention. In FIG. 7, the same members as that shown in FIGS. 1 and 2 are denoted by the same numerical references as that shown in FIGS. 1 and 2.

Referring to FIG. 7, the corona discharger comprises the discharge wire 1, the back plate 2, the side plates 3 and 4, and the photoconductive drum 6, wherein the back plate 2 is electrically grounded, and the side plates 3 and 4 are electrically grounded through resistors 51 and 52, respectively. Since a voltage drop is caused across the resistors 51 and 52 by an ion stream flowing onto the side plates 3 and 4, respectively, there is caused a difference between the electric potential of the back plate 2 and the electric potential of each of the side plates 3 and 4.

In the corona discharger of the second preferred embodiment shown in FIG. 7, it is preferable that the distance between the discharge wire 1 and the back plate 2 is set to be smaller than the distance between the discharge wire 1 and the photoconductive drum 6, so that the air stream induced by the produced ions flows in a direction as indicated by an arrow of dotted line, namely, in a direction from the photoconductive drum 6 toward the outlets 8 and 9 for discharging the produced ozone.

Figure 8A:
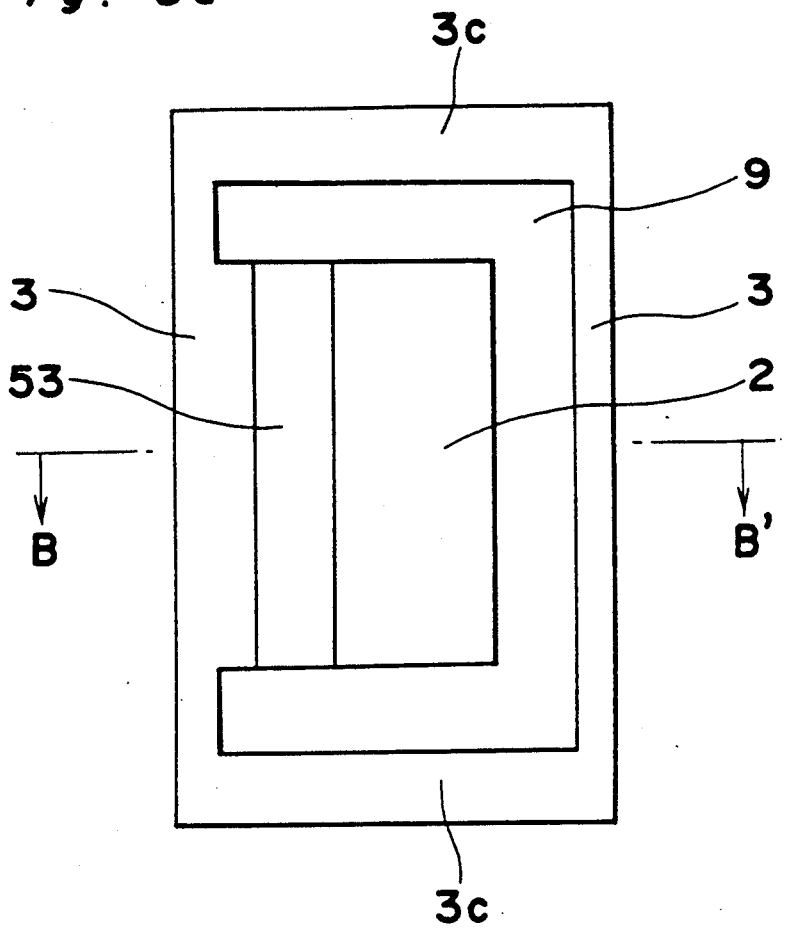
FIG. 8*a* is a schematic top plan view showing a corona discharger of a third preferred embodiment according to the present invention.
Figure 8B:
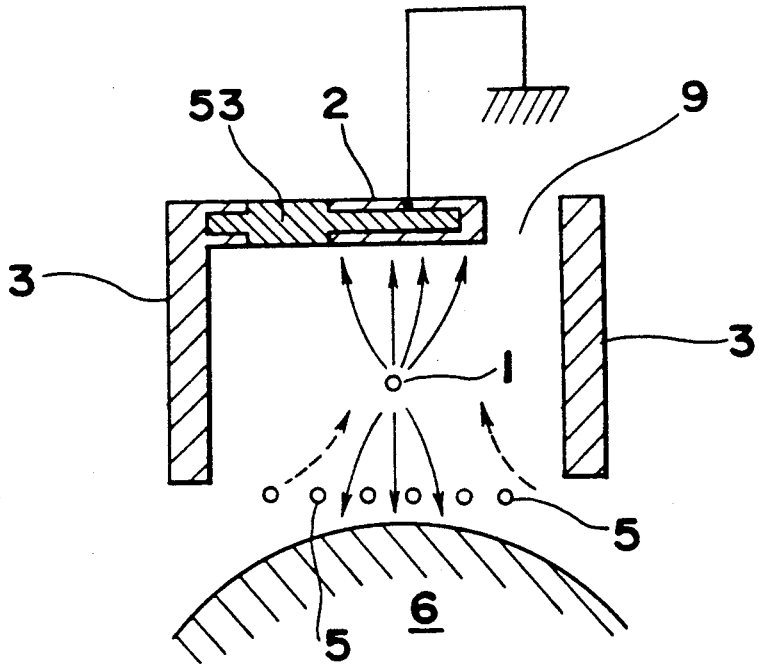
FIG. 8*b* is a schematic cross sectional view taken on line B—B' of FIG. 8*a;*

FIGS. 8*a* and 8*b* show a corona discharger of a third preferred embodiment according to the present invention.

Referring to FIGS. 8*a* and 8*b*, the corona discharger of the third preferred embodiment comprises the discharge wire 1, the back plate 2, the side plates 3, and the screen grid 5. The side plates 3 provided on both sides of the discharge wire 1 are connected integrally through connection members 3*c* as shown in a top plan view of FIG. 8*a*, and the back plate 2 is connected to the side plate 3 through resistor member 53 having a longitudinal length parallel to the axis direction of the photoconductive drum 6. Further, there is formed an outlet 9 having a shape like character C. Accordingly, the corona discharger of the third preferred embodiment has an electric circuit similar to that of the corona discharger of the second preferred embodiment shown in FIG. 7.

Figure 9:
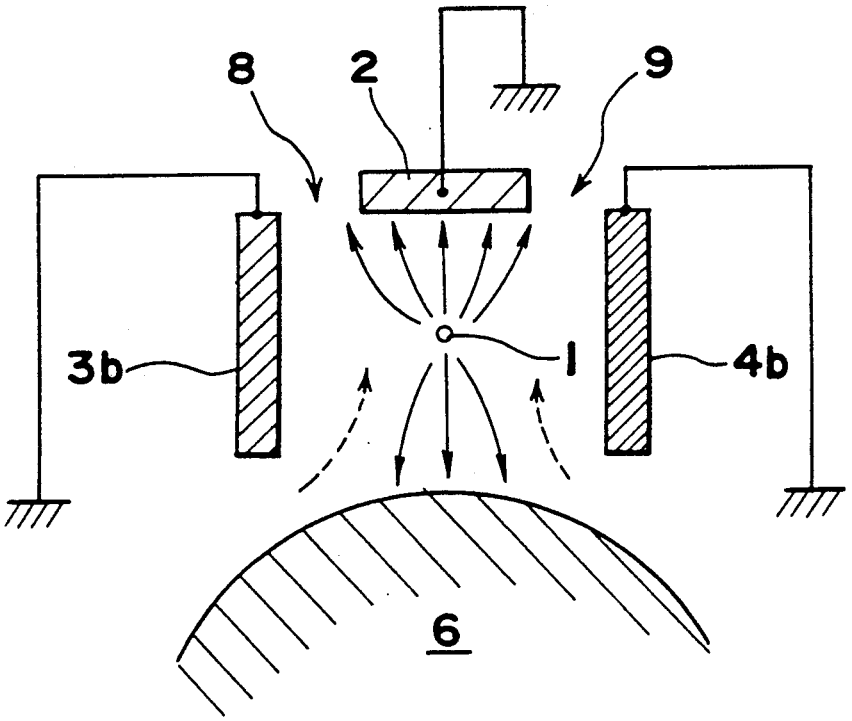
FIG. 9 is a schematic cross sectional view showing a corona discharger of a fourth preferred embodiment according to the present invention.

FIG. 9 shows a corona discharger of a fourth preferred embodiment according to the present invention.

Referring to FIG. 9, the corona discharger of the fourth preferred embodiment comprises the discharge wire 1, the back plate 2, an electrically conductive side plate 3*b*, and an electrically conductive side plate 4*b*, wherein the side plates 3*b* and 4*b* are made of the aforementioned resistor member, and outlets 8 and 9 for discharging the produced ozone are formed between the back plate 2 and the side plates 3*b* and 4*b*, respectively. The back plate 2 and the side plates 3*b* and 4*b* are electrically grounded. In this case, when respective portions of the side plates 3*b* grounded as shown in FIG. 9, a portion of each of the side plates 3*b* and 4*b* closer to the photoconductive drum 6 has a higher electric potential. Therefore, the air stream induced by the produced ions flows efficiently toward the outlets 8 and 9.

Figure 10:
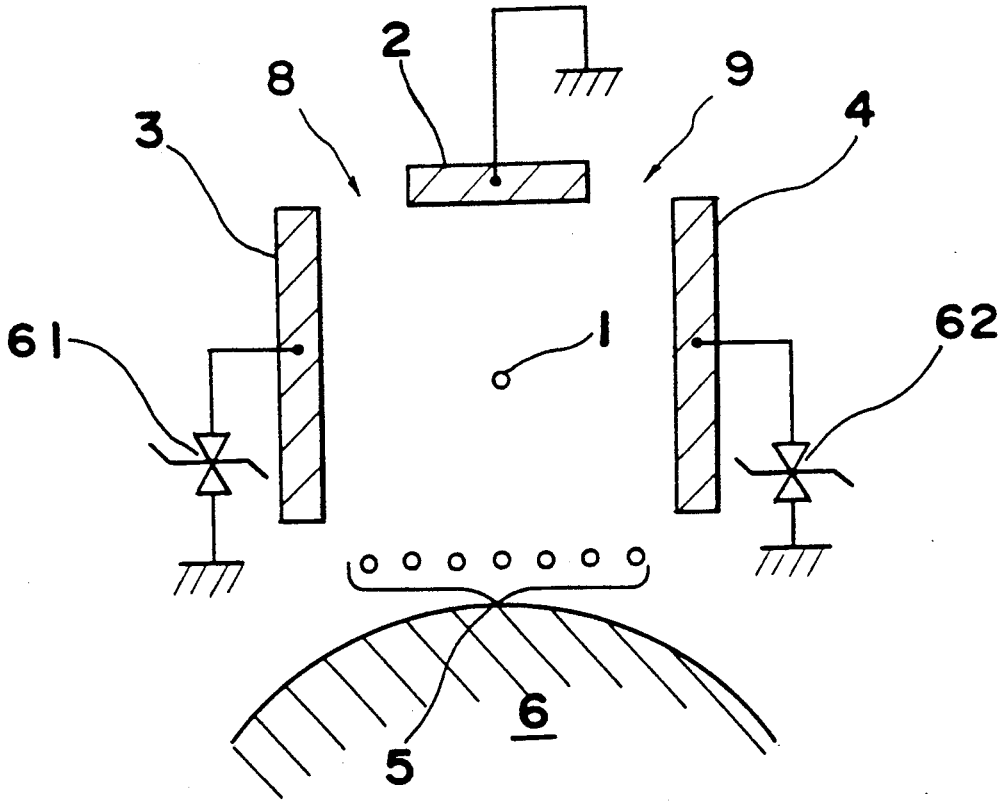
FIG. 10 is a schematic cross sectional view showing a corona discharger of a fifth preferred embodiment according to the present invention.

FIG. 10 shows a corona discharger of a fifth preferred embodiment according to the present invention.

Referring to FIG. 10, the corona discharger of the fifth preferred embodiment comprises varisters 61 and 62 in place of the resistors 51 and 52 of the corona discharger shown in FIG. 7. Since the ion stream flowed onto the side plates 3 and 4 flows through the varisters 61 and 62 to ground, there is caused a difference between the electric potential of the back plate 2 and the electric potential of each of the side plates 3 and 4. Therefore, the ions stream can be prevented from flowing onto the side plates 3 and 4.

In the corona dischargers of the first to fifth preferred embodiments, as described above, various kinds of means such as the bias voltage source are used in order to control the ion stream by causing a difference between respective electric potentials of the plates of the shielding plates. However, the present invention is not limited to this. The other means and various kinds of combinations of these means may be used in place of the bias voltage source, for example, as follows.

Figure 11:
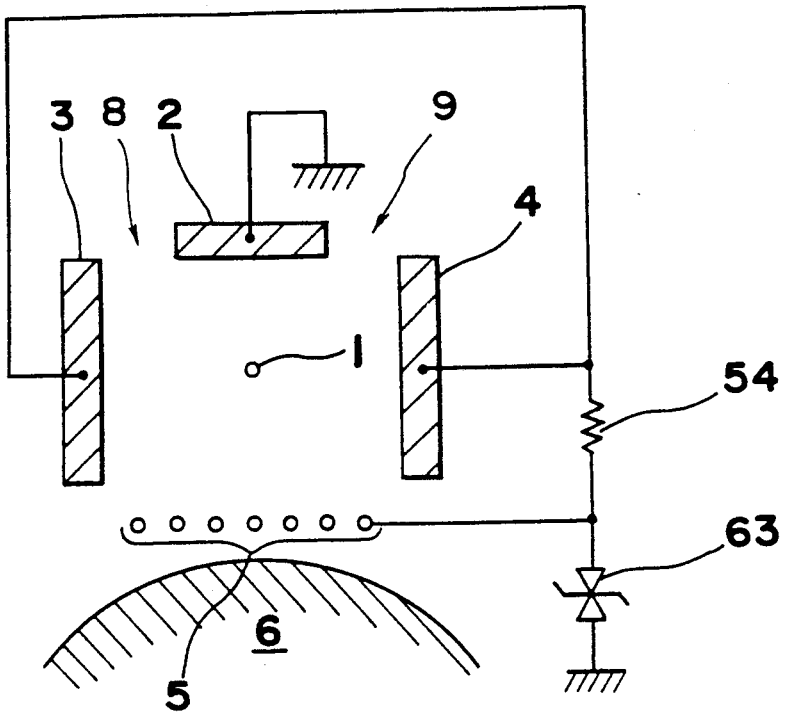
FIG. 11 is a schematic cross sectional view showing a corona discharger of a sixth preferred embodiment according to the present invention.

FIG. 11 shows a corona discharger of a sixth preferred embodiment according to the present invention.

Referring to FIG. 11, the corona discharger of the sixth preferred embodiment comprises the discharge wire 1, the back plate 2, the side plates 3 and 4, and the screen grid 5 similarly to that of the corona discharger of the second preferred embodiment shown in FIG. 7. However, in this case, the screen grid 5 is connected through a varister 63 to ground, and a resistor 54 is connected between the screen grid 5 and respective side plates 3 and 4. In the corona discharger, the bias voltage to be applied to the side plates 3 and 4 is set depending on the grid control voltage to be applied to the screen grid 5.

Figure 12:
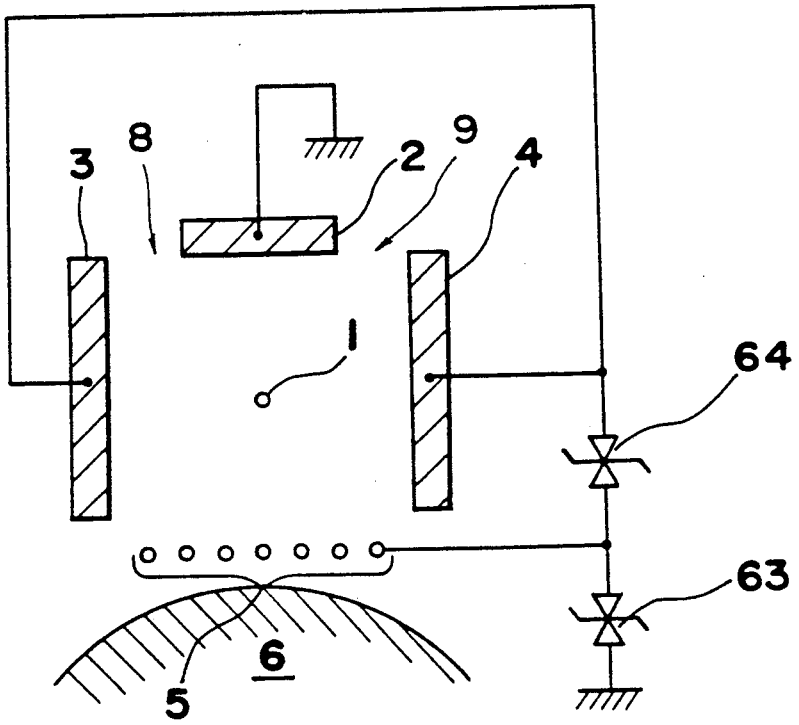
FIG. 12 is a schematic cross sectional view showing a corona discharger of a seventh preferred embodiment according to the present invention.

FIG. 12 shows a corona discharger of a seventh preferred embodiment according to the present invention.

Referring to FIG. 12, the corona discharger of the seventh preferred embodiment comprises a varister 64 in place of the resistor 54 of the corona discharger of the sixth preferred embodiment shown in FIG. 11. In this case, the varister 64 is connected between the screen grid 5 and respective side plates 3 and 4. In the corona discharger, the bias voltage to be applied to the side plates 3 and 4 is set depending on the grid control voltage to be applied to the screen grid 5.

Figure 13:
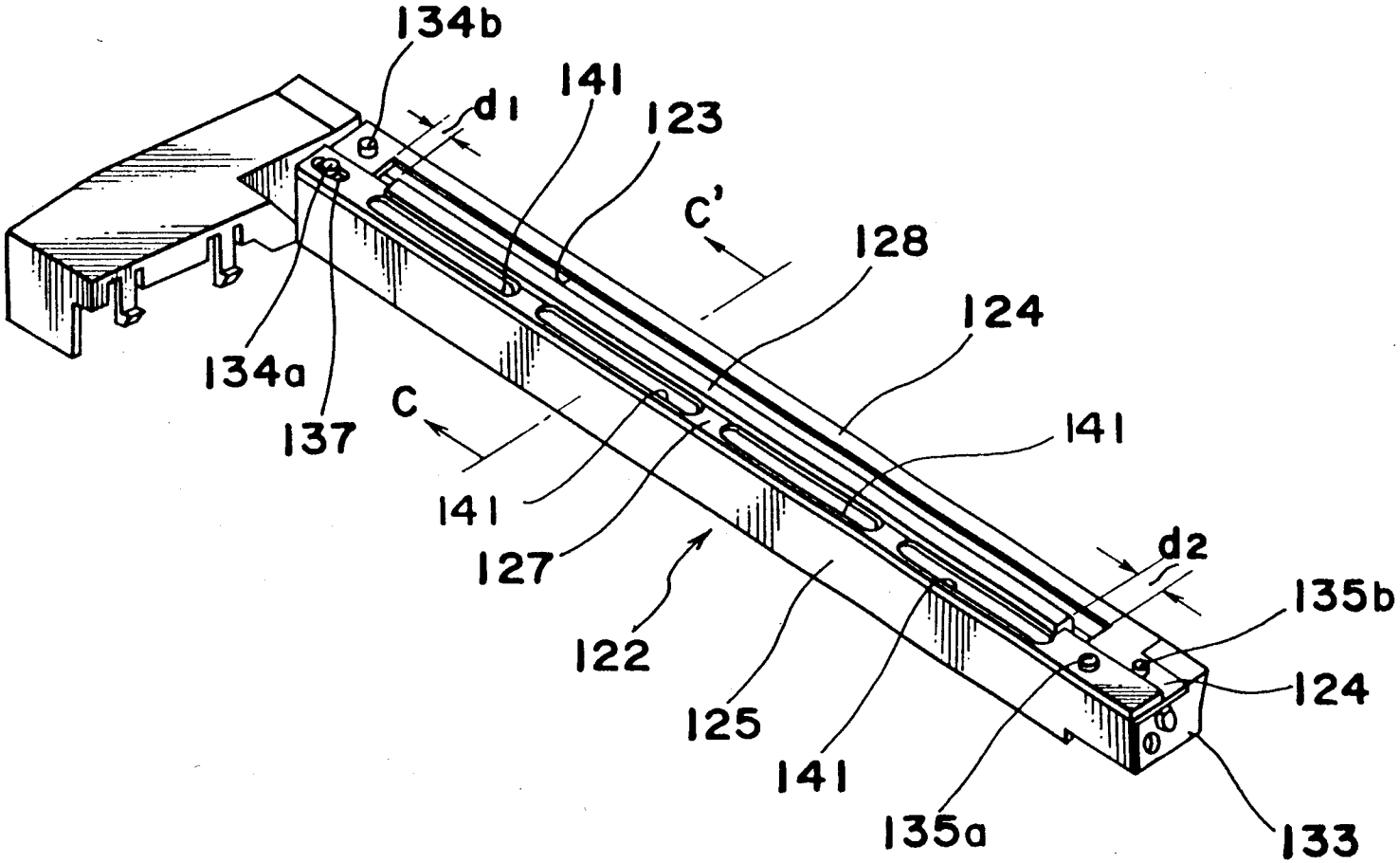
FIG. 13 is a perspective view showing a corona discharger of an eighth preferred embodiment according to the present invention.
Figure 14:
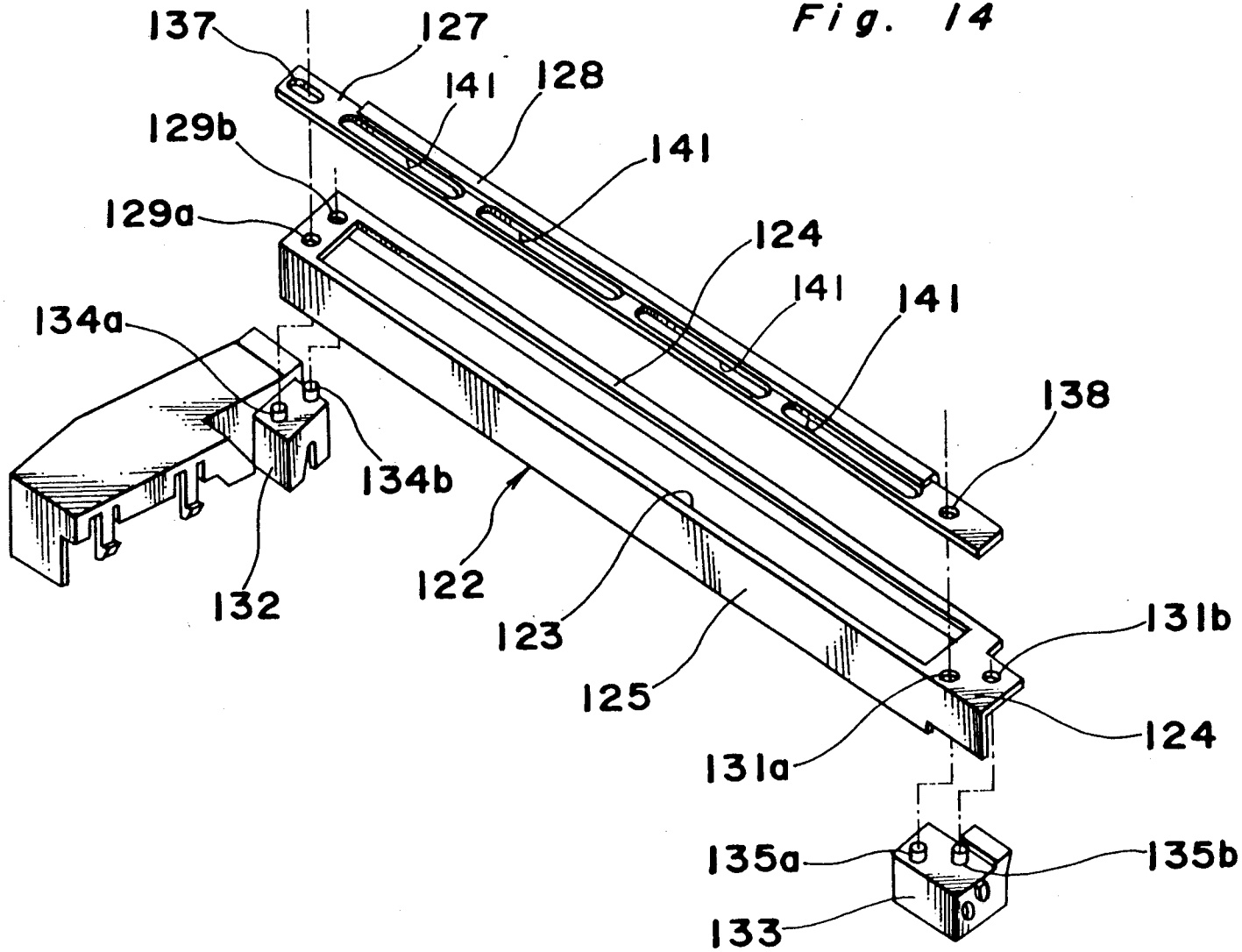
FIG. 14 is a partially exploded perspective view showing the corona discharger shown in FIG. 13.
Figure 15:
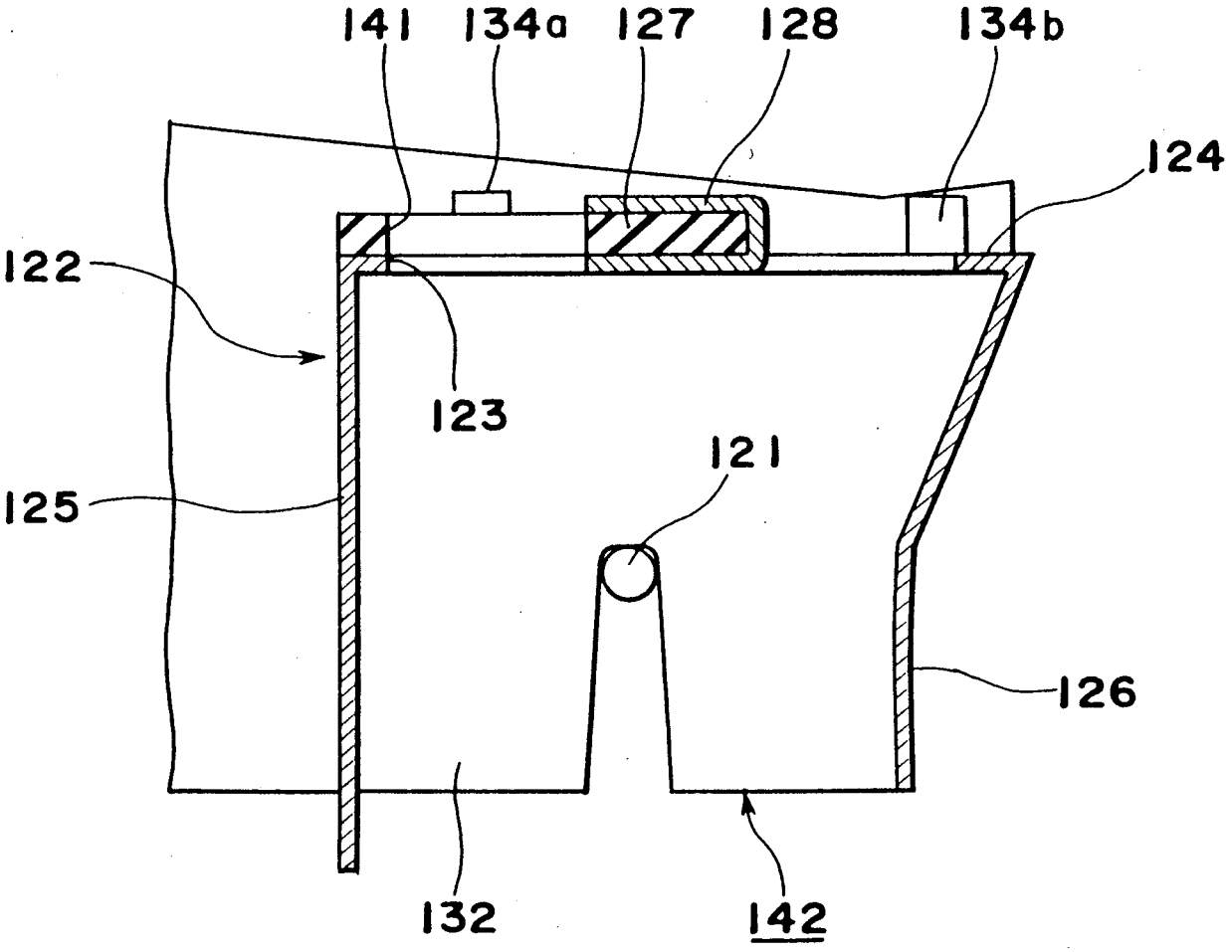
FIG. 15 is a schematic cross sectional view taken on line C—C' of FIG. 13.

FIG. 13 is a perspective view showing an appearance of a corona discharger of an eighth preferred embodiment according to the present invention, FIG. 14 is a partially exploded perspective view of the corona discharger shown in FIG. 13, and FIG. 15 is a schematic cross sectional view taken on line C—C' of FIG. 13.

Referring to FIGS. 13 to 15, the corona discharger of the eighth preferred embodiment comprises an electrically conductive corona discharge wire 121, and an electrically conductive shielding member 122 for stabilizing the produced corona discharge which is provided so as to surround the corona discharge wire 121. The shielding member 122 comprises a connection plate 124 having a rectangular opening 123 for discharging the produced ozone having a predetermined width which is formed therein, and a pair of side plates 125 and 126 which are connected through the connection plate 124 are formed so as to oppose to each other. The shielding member 122 further comprises an electrically insulating resin plate 127 which is fixed in the connection plate 124 by being mounted in the ozone discharging opening 123 along the corona discharger wire 121, and an electrically conductive back plate 128 electrically insulated from the side plates 125 and 126 which is fixed on the insulating resin plate 127.

The connection plate 124 for connecting the side plates 125 and 126 has two holes **129*a* and 129*b* for positioning the connection plate 124 which are formed between one end thereof and one edge of the opening 123 for discharging the ozone, and the connection plate 124 further has two holes 131*a* and 131*b* for positioning the connection plate 124 which are formed between another end thereof and another edge of the opening 123**.

The shielding member 122 is fixed in electrically insulating resin holders 132 and 133 so that one end and another end of the shielding member 122 are fitted in the insulating resin holders 132 and 133, respectively, as follows Namely, as shown in FIG. 14, the holder 132 has positioning pins **134*a* and 134*b* which project from one surface thereof, and these positioning pins 134*a* and 134*b* are fitted into the positioning holes 129*a* and 129*b* of the connection plate 124, respectively, so as to position and fix one end of the connection plate 124 thereat. Similarly, another holder 133 has positioning pins 135*a* and 135*b* which projects from one surface thereof, and these positioning pins 135*a* and 135*b* are fitted into the positioning holes 131*a* and 131*b* of the connection plate 124, respectively, so as to position and fix another end of the connection plate 124** thereat.

The discharge wire 121 is mounted between both the holders 132 and 133 so as to be positioned at approximately the center of these holders 132 and 133.

On the other hand, the insulating resin plate 127 has approximately half the width of the opening 123 for discharging the ozone of the shielding member 122. A back plate 128 having a U-shaped cross section which has a longitudinal length shorter than that of the opening 123 is fixed into the insulating resin plate 127 by pressing it into a position of a depth thereof equal to approximately half the width of the insulating resin plate 127 from one side of the insulating resin plate 127. Further, the insulating resin plate 127 is fixed on the holders 132 and 133 by inserting one positioning pin **134*a* of the holder 132 and another positioning pin 135*a* of the holder 133 corresponding thereto into the positioning holes 137 and 138 of the insulating resin plate 127, respectively. Then, the insulating resin plate 127 is mounted on the connection plate 124 so that the back plate 128 is positioned at approximately the center of the width of the ozone discharging openings 123, as shown in FIG. 15**.

In a top portion of the insulating resin plate 127 which is not covered by the back plate 128, there are formed plural longitudinal holes 141, each hole 141 having a width equal to approximately half the width of the insulating resin plate 127. These longitudinal holes 141 can prevent an opening area of the opening 123 from becoming smaller, namely, can prevent the discharge efficiency of the produced ozone from decreasing when the insulating resin plate 127 is mounted on the ozone discharging opening 123.

In order to make the electric field in the vicinity of the ozone discharging opening 123 become higher than the electric field in the vicinity of the corona discharge opening 142 (See FIG. 15) which is formed on the opposite side thereof, for example, the back plate 128 is electrically grounded, and a voltage of −2 KV is applied by a common bias voltage source to the side plates 125 and 126.

In the corona discharger of the eighth preferred embodiment shown in FIGS. 13 to 15, the longitudinal length of the back plate 128 is smaller than the longitudinal length of the ozone discharging opening 123. Therefore, as shown in FIG. 13, there are defined certain insulating gaps $d_1$ and $d_2$ at a position between one end of the back plate 128 and the inner edge of the opening 123 of the shielding member 122, and a position between another end of the back plate 128 and another inner edge of the opening 123, respectively.

Further, as described above, the insulating resin plate 127 supports the back plate 128 so that the back plate 128 is located at approximately the center of the width of the opening 123. Then, as is the most clearly apparent from FIG. 15, it is established that the back plate 128 is electrically insulated from the connection member 124 in a direction of the width of the opening 123 thereof.

Furthermore, since the insulating resin plate 127 is supported on the connection plate 124, there is obtained a large strength for a load to be applied to the back plate 128 which is fixed on the insulating resin plate 127.

As corona dischargers, there are known to those skilled in the art, a colotron type corona discharger for controlling a corona discharge by controlling a voltage to be applied to a discharge wire, and a scolotron type corona discharger for controlling a corona discharge by controlling both of a voltage to be applied to the discharge wire and a voltage to be applied to a screen grid or a grid for controlling the ion stream. The eighth preferred embodiment according to the present invention shown in FIGS. 13 to 15 can be applied to both type corona dischargers.

According to the eighth preferred embodiment, since the back plate 128 is supported in the inside area of the opening 123 for discharging the ozone by the insulating resin plate 127 and is fixed by the insulating resin plate 128 so as to be positioned on the connection plate 124, it is established that the back plate 128 is electrically insulated from the side plates 125 and 126, there are obtained a certain predetermined electric field by correct sizes of these members, and also improvement of assembling these members.

In the aforementioned preferred embodiments, there are described the cases when the back plate is provided at a position which is located on the opposite side of the corona discharge wire to the photoconductive drum and is the farthest from the photoconductive drum. However, the present invention is not limited to this. There may be provided a back plate having another shape at a position different from that of the aforementioned preferred embodiments as follows.

Figure 16:
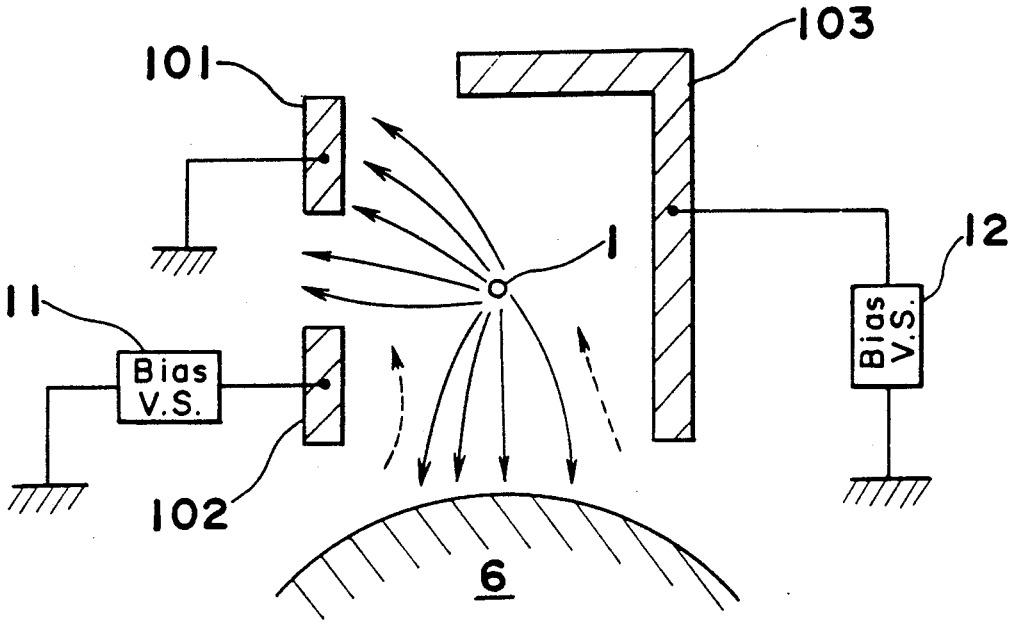
FIG. 16 is a schematic cross sectional view showing a corona discharger of a ninth preferred embodiment according to the present invention.

FIG. 16 shows a corona discharger of a ninth preferred embodiment according to the present invention.

Referring to FIG. 16, the corona discharger of the ninth preferred embodiment comprises the discharge wire 1, an electrically conductive back plate 101, and electrically conductive side plates 102 and 103. In the corona charger, the back plate 101 and the side plate 102 are provided on one side of the discharge wire 1 so as to oppose to the side plate 102 and so that the back plate 101 is located at a position farther than the side plate 102 from the photoconductive drum 6. Another side plate 103 having a shape of a character L is provided on the top side and another side of the discharge wire 1.

The back plate 101 is electrically grounded. In order to decrease the flow amount of the ion stream flowing onto the side plate 102 and 103, a bias voltage having the same polarity as that of the ion stream is applied to the side plate 102 by a bias voltage source 11, and a bias voltage having the same polarity as that of the ion stream is applied to the side plate 103 by a bias voltage source 12. Then, there is produced the corona discharge mainly between the discharge wire 1 and the back plate 101, and the corona discharge can be stabilized. Further, an air stream induced by the ions flowing onto the back plate 101 flows through an area located between the back plate 101 and the side plate 102 and through another area located between the back plate 101 and the side plate 103.

Figure 17:
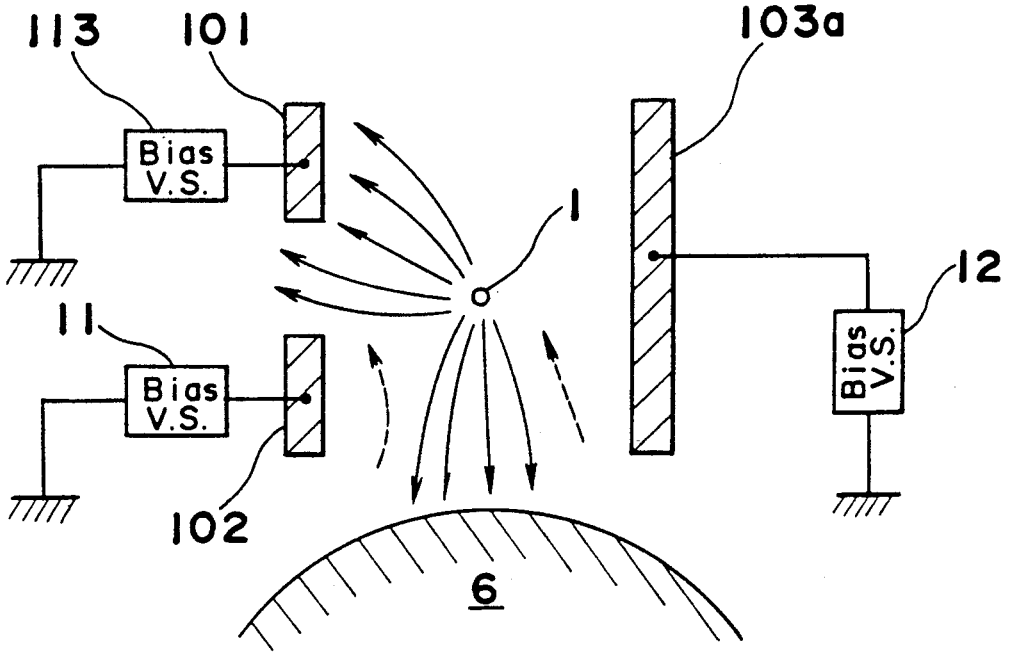
FIG. 17 is a schematic cross sectional view showing a corona discharger of a tenth preferred embodiment according to the present invention.

FIG. 17 shows a corona discharger of a tenth preferred embodiment according to the present invention.

Referring to FIG. 17, a bias voltage having a polarity opposite to that of the voltage applied to the discharge wire 1 is applied to the back plate 101 by a bias voltage source 113. Then, there is produced a relatively large ion stream flowing onto the back plate 101 by means of the bias voltage of the bias voltage source 113. Therefore, there is provided an electrically conductive side plate **103*a* only on the side of the discharge wire 1**. As a result, the corona discharge can be stabilized.

Figure 18:
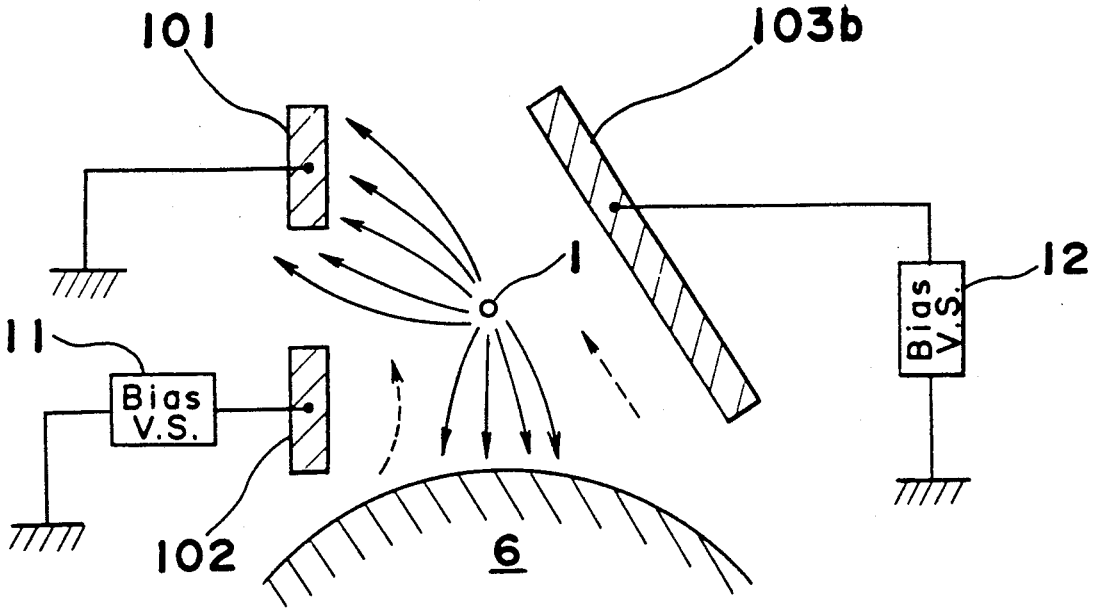
FIG. 18 is a schematic cross sectional view showing a corona discharger of an eleventh preferred embodiment according to the present invention.

FIG. 18 shows a corona discharger of an eleventh preferred embodiment according to the present invention.

Referring to FIG. 18, there is provided an electrically conductive side plate **103*b* on the right side of the discharge wire 1 so as to be inclined from the direction of the width of each of the back plate 101 and the side plate 102, in place of the side plate 103 of the corona discharger of the ninth preferred embodiment shown in FIG. 16. In the corona discharger, the back plate 101 is electrically grounded, and a bias voltage is applied to the side plate 102 by the bias voltage source 11**.

Figure 19:
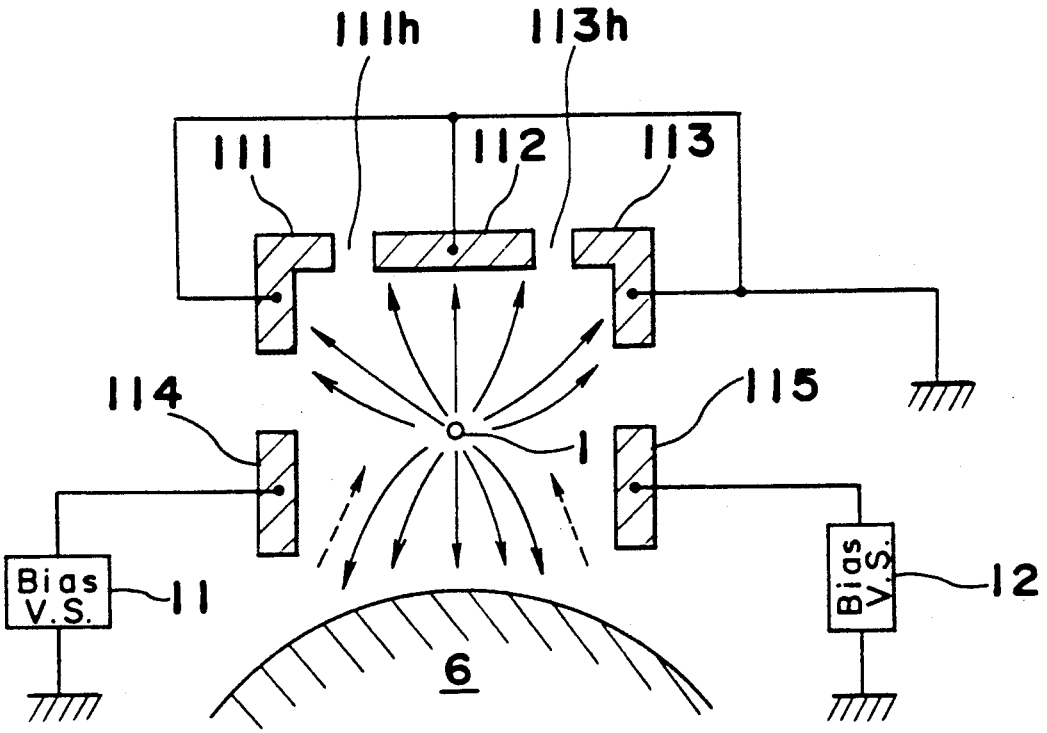
FIG. 19 is a schematic cross sectional view showing a corona discharger of a twelfth preferred embodiment according to the present invention.

FIG. 19 shows a corona discharger of a twelfth preferred embodiment according to the present invention.

Referring to FIG. 19, the corona discharger of the twelfth preferred embodiment comprises the discharge wire 1, an electrically conductive back plate composed of portions 111 to 113, and a pair of electrically conductive side plates 114 and 115. The portions 111 to 113 of the back plate are provided on the upper left side, the upper center side and the upper right side of the discharge wire 1 so as to oppose to the photoconductive drum 6, and there are formed outlets **111*h* and 113*h* for discharging the air stream induced by the produced ions at a position located between respective portions 111 and 112 of the back plate and at a position located between respective portions 112 and 113 thereof, respectively. On the other hand, a pair of side plates 114 and 115 are provided at a position between the portion 111 of the back plate and the photoconductive drum 6 and at a position between the portion 113 of the back plate and the photoconductive drum 6, respectively, and the side plates 114 and 115 are connected to the bias voltage sources 11 and 12**, respectively.

In the corona discharger shown in FIG. 19, an air stream induced by the produced ions flows out through the outlets **111*h* and 113*h*** to the outside of the corona discharger.

FIGS. **20*a* and 20*b*** show a corona discharger of a thirteenth preferred embodiment according to the present invention.

Referring to FIGS. **20*a* and 20*b*, the corona discharger of the thirteenth preferred embodiment comprises the discharge wire 1, an electrically conductive back plate 302 provided on the upper side of the discharge wire 1, and a pair of electrically conductive side plates 303 and 304 provided on both sides of the discharge wire 1. The left side peripheral surface of the back plate 302 is bonded onto the upper right side surface of the side plate 303 through an electrically insulating plate 340, and the right side peripheral surface of the back plate 302 is bonded onto the upper left side surface of the side plate 304 through an electrically insulating plate 341. It is to be noted that the discharge wire 1 is located at a position nearer to the back plate 302 than the photoconductive drum 6. In the back plate 302, there are formed plural outlets 308 for discharging the ozone parallel to the longitudinal direction of the discharge wire 1, and the back plate 302 is electrically grounded. Further, a bias voltage having the same polarity as that of a voltage applied to the discharge wire 1 is applied to the side plates 303 and 304 by a bias voltage source 11***a*.

Figure 20A:
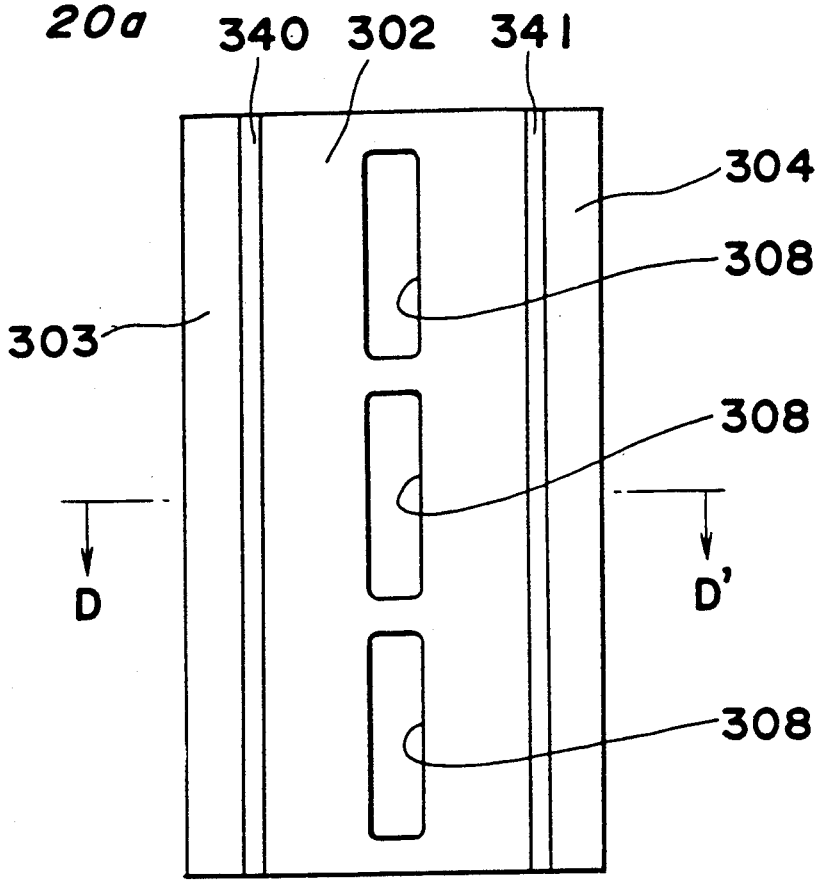
FIG. 20*a* is a schematic top plan view showing a corona discharger of a thirteenth preferred embodiment according to the present invention.
Figure 20B:
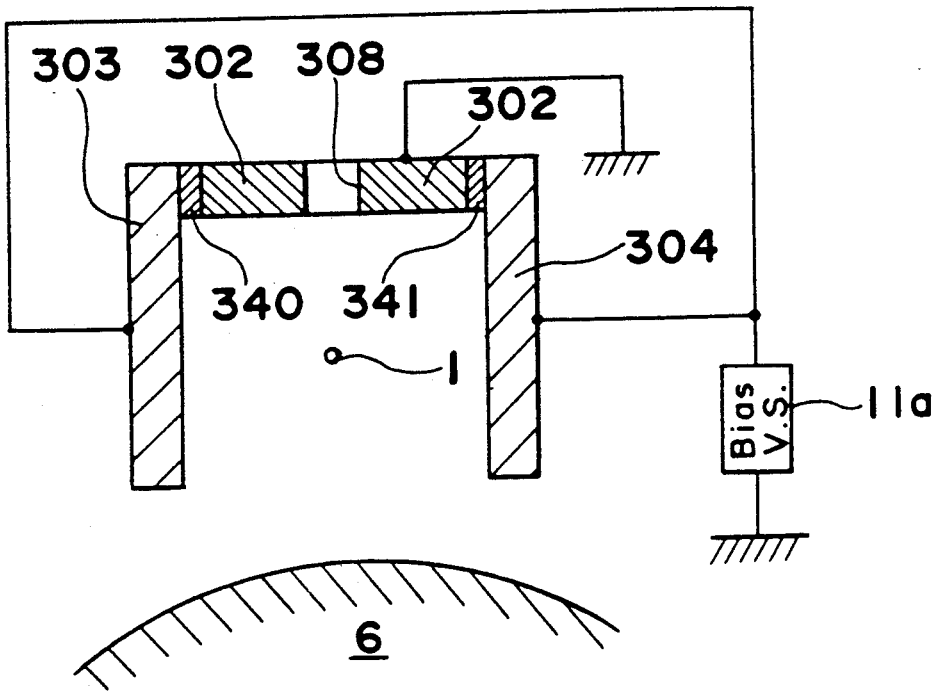
FIG. 20*b* is a schematic cross sectional view taken on line D—D' of FIG. 20*a;*

In the corona discharger of the thirteenth preferred embodiment shown in FIGS. 20*a* and 20*b*, the ions produced around the discharge wire 1 flows mainly toward the back plate 302 and the photoconductive drum 6. Since the discharge wire 1 is located at the position nearer to the back plate 302 than the photoconductive drum 6 and plural outlets 308 for discharging the produced ozone are formed in the back plate 302, the air stream induced by the produced ions flows from the vicinity of the photoconductive drum 6 through the plural outlets 308 to the outside of the corona discharger more efficiently than the conventional corona discharger.

Figure 21A:
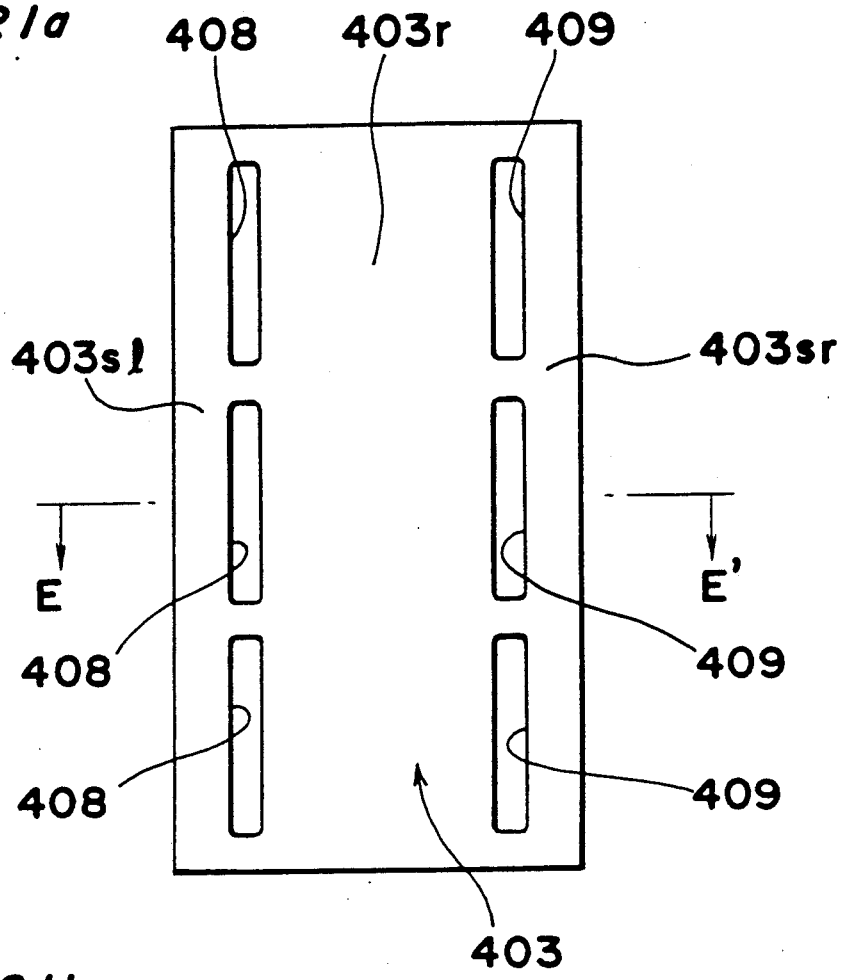
FIG. 21*a* is a schematic top plan view showing a corona discharger of a fourteenth preferred embodiment according to the present invention.
Figure 21B:
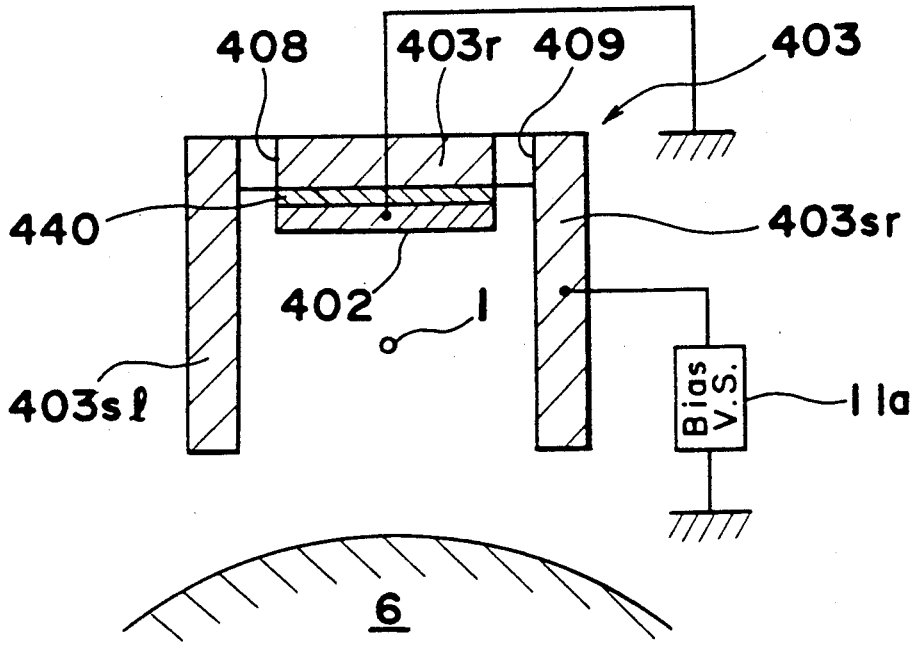

FIGS. 21*a* and 21*b* show a corona discharger of a fourteenth preferred embodiment according to the present invention.

Referring to FIGS. 21*a* and 21*b*, the corona discharger of the fourteenth preferred embodiment comprises the discharge wire 1, an electrically conductive shielding plate 403 integrally comprising a back plate 403*r* and a pair of side plates 403*sl* and 403*sr*, and an electrically conductive back plate 402, wherein the back plate 403*r* of the shielding plate 403 is provided on the upper side of the discharge wire 1 so as to oppose to the photoconductive drum 6, and the side plates 403*sl* and 403*sr* thereof are provided on both sides of the discharge wire 1 so as to oppose to each other. The back plate 402 is bonded onto the lower surface of the back plate 403*r* through an electrically insulating plate 440 so as to be provided on the upper side of the discharge wire 1 along the longitudinal direction of the discharge 1. In a boundary portion located between the back plate 403*r* and the side plate 403*sl*, there are formed plural outlets 408 for discharging the produced ozone, and in a boundary portion located between the back plate 403*r* and the side plate 403*sr*, there are formed plural outlets 409 therefor. A bias voltage is applied to the shielding plate 403 by the bias voltage source 11*a*, and the back plate 402 is electrically grounded.

The corona discharger of the fourteenth preferred embodiment shown in FIGS. 21*a* and 21*b* has such a feature that the shielding plate 403 and the back plate 402 can be easily shaped.

In the above preferred embodiments, the corona dischargers are applied to the corona chargers. A preferred embodiment of a transfer charger to which the present invention is applied will be described below.

Figure 22:
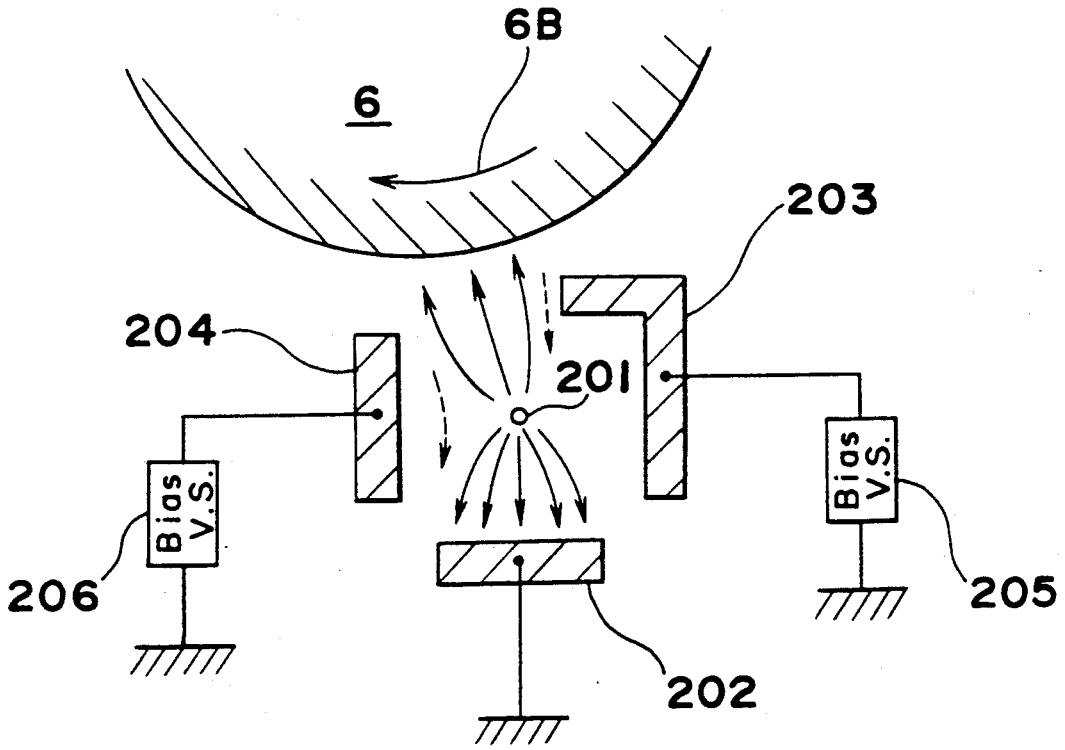
* and FIG. 22 is a schematic cross sectional view showing a transfer charger of a fifteenth preferred embodiment according to the present invention.

FIG. 22 shows a transfer charger for an electrophotographic copying machine of a fifteenth preferred embodiment according to the present invention.

In a conventional transfer charger, for example, for use in a conventional electrophotographic copying machine, electrically grounded shielding plates are provided around a discharge wire.

On the other hand, in the fifteenth preferred embodiment shown in FIG. 22, an electrically conductive back plate 202 is provided on the opposite side of an electrically conductive corona discharge wire 201 to the photoconductive drum 6 so as to oppose to the photoconductive drum 6 which is rotated in a rotation direction as indicated by an arrow 6B of FIG. 22, and a pair of electrically conductive side plates 203 and 204 are provided on both sides of the discharge wire 201. The back plate 202 is electrically grounded, and predetermined bias voltages are applied to the side plates 203 and 204 by bias voltage sources 205 and 206, respectively.

In the transfer charger shown in FIG. 22, the flow amount of the ion stream flowing onto the side plates 203 and 204 can be decreased. Further, the corona discharge is produced mainly an area located between the discharge wire 201 and the back plate 202, and an air stream induced by the produced ions flows in such a direction that the air stream leaves the photoconductive drum 6. Accordingly, the damage caused to the photoconductive drum 6 can be lowered.

In the corona dischargers of the preferred embodiments according to the present invention, a relatively strong air stream induced by the ions can be prevented from flowing toward the photoconductive drum since the electric field in the vicinity of the outlets for the corona discharge is relatively weak and the electric field in the vicinity of the outlets for discharging the produced ozone is relatively strong. Further, since the flow amount of the ions flowing onto the shielding plates is decreased, the power consumption can be decreased, and the cost of manufacturing the corona discharger can be decreased. Furthermore, the corona discharge can be further stabilized as compared with the conventional corona dischargers. Since the amount of the produced ozone decreases and the produced ozone can be prevented from flowing toward the photoconductive drum, the damage caused to the photoconductive drum can be lowered.

As corona dischargers, there are known to those skilled in the art, a colotron type corona discharger for controlling a corona discharge by controlling a voltage to be applied to a discharge wire, and a scolotron type corona discharger for controlling a corona discharge by controlling both of a voltage to be applied to the discharge wire and a voltage to be applied to a screen grid or a grid for controlling the ion stream. The aforementioned preferred embodiments according to the present invention can be applied to both type corona dischargers.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. A corona discharger comprising:

a discharge member for producing a corona discharge;

means for applying a predetermined voltage to said discharge member;

an electrically conductive back plate being provided on the opposite side of said discharge member to a member to be electrified;

an electrically conductive side plate being provided close to said member to be electrified;

an opening for discharging ozone produced by said corona discharge, said opening being formed between said side plate and said back plate; and means for setting respective electric potentials of said side plate and said back plate so that a difference between respective electric potentials of said side plate and said discharge member becomes lower than a difference between respective electric potentials of said back plate and said discharge member.

2. The corona discharger as claimed in claim 1, wherein a distance between said back plate and said discharge member is smaller than a distance between said member to be electrified and said discharge member.

3. A corona discharger comprising:

a discharge member for producing a corona discharge;

means for applying a predetermined voltage to said discharge member;

a shielding member being provided so as to surround said discharge member, said shielding member including at least two portions which are electrically insulated from each other, said shielding member having a first opening which is formed so as to oppose to said member to be electrified, and a second opening for discharging ozone produced by said corona discharge which is formed between said two portions thereof; and electric potential setting means for setting respective electric potentials of said two portions of said shielding member so as to be different from each other.

4. The corona discharger as claimed in claim 3, wherein said electric potential setting means sets respective electric potentials of said two portions of said shielding member so that the electric potential of said one portion thereof closer to said first opening than said another portion thereof becomes nearer to the electric potential of said discharge member than the electric potential of said another portion thereof.

5. The corona discharger as claimed in claim 3, wherein said two portions of said shielding member are a back plate provided on the opposite side of said discharge member to said first opening, and a side plate provided so as to be closer to said first opening than said back plate.

6. The corona discharger as claimed in claim 5, wherein said electric potential setting means comprises means for applying to said side plate a predetermined voltage having the same polarity as that of the predetermined voltage to be applied to said discharge means.

7. The corona discharger as claimed in claim 5, wherein said back plate is provided so that a distance between said back plate and said discharge member becomes smaller than a distance between said discharge member and said member to be electrified.

8. The corona discharger as claimed in claim 6, wherein said electric potential setting means comprises means for electrically grounding said back plate.

9. The corona discharger as claimed in claim 5, wherein said electric potential setting means comprises means for electrically grounding said side plate through an electric resistance.

10. The corona discharger as claimed in claim 5, wherein said electric potential setting means comprises means for electrically grounding said side plate through a varister.

11. A corona discharger comprising:

discharge member for producing a corona discharge;

means for applying a predetermined voltage to said discharge member;

shielding member being provided so as to surround said discharge member, said shielding member having a first opening for said corona discharge and a second opening for discharging a gas produced within said shielding member; and electric potential setting means for setting electric potentials of respective portions of said shielding means so that said electric potentials of respective portions thereof are different from each other.

12. The corona discharger as claimed in claim 11, wherein said electric potential setting means includes means for setting said electric potentials of said shielding member so that an electric potential of a portion of said shielding means close to said first opening thereof is kept having the same polarity as that of said discharge member.

13. The corona discharger as claimed in claim 12, wherein said portion of said shielding member close to said first opening thereof is electrically insulated from the other portions of said shielding means.

14. The corona discharger as claimed in claim 11, wherein said electric potential setting means sets an electric potential of a portion of said shielding member close to said second opening thereof so as to become nearer to that of said discharge means than that of a portion of said shielding member close to said second opening thereof.

15. A corona discharger for discharging for a member to be electrified or to be discharged, comprising:

a discharge member for producing a corona discharge;

plural shielding members being provided close to said discharge member, said plural shielding members being electrically insulated from each other; and electric potential setting means for setting an electric potential of a portion of said shielding member closer to said member to be electrified or to be discharged so as to become an electric potential nearer to that of said discharge member, whereby an air stream induced in the vicinity of said discharge member flows so as to leave said member to be electrified or to be discharged.

16. A corona discharger comprising:

a discharge member for producing a corona discharge;

means for applying a predetermined voltage to said discharge member;

an electrically conductive back plate being located on the opposite side of said discharge member to a member to be electrified by said discharge member, an opening for discharging ozone being formed in said back plate;

an electrically conductive side plate being located at a position closer to said member to be electrified than said back plate, said side plate being electrically insulated from said back plate; and means for setting predetermined electric potentials of said side plate and said back plate so that a difference between respective electric potentials of said side plate and said discharge member becomes smaller than a difference between respective electric potentials of said back plate and said discharge member.

17. A corona discharger comprising:

a discharge member for producing a corona discharge;

means for applying a predetermined voltage to said discharge member;

a shielding member being provided so as to surround said discharge member, said shielding member having a first opening being formed so as to be oppose to a member to be electrified and a second opening for discharging an inner gas produced within said shielding member, said shielding member including an electrically conductive back plate being located on the opposite side of said discharge member to said member to be electrified, and an electrically conductive side plate being electrically insulated from said back plate and located close to said member to be electrified; and means for setting predetermined electric potentials of said side plate and said back plate so that a difference between respective electric potentials of said side plate and said discharge member becomes smaller than a difference between respective electric potentials of said back plate and said discharge member.

18. A corona discharger comprising:

a discharge member for producing a corona discharge;

means for applying a predetermined voltage to said discharge member;

a shielding member being provided so as to surround said discharge member, said shielding member having a first opening for said corona discharge and a second opening for discharging an inner gas within said shielding member, said shielding member comprising a first member close to said first opening and a second member being located at a position farther from said first opening than said first member; and means for setting predetermined electric potentials of said side plate and said back plate so that a difference between respective electric potentials of said first member and said discharge member becomes smaller than a difference between respective electric potentials of said second member and said discharge member.

19. The corona discharger as claimed in claim 18, wherein said second member is located at a predetermined position so that an electric field induced between said second member and said discharge member becomes higher than an electric field induced between said discharge member and a member to be electrified.

20. A corona discharger comprising:

a corona discharge wire for producing a corona discharge;

a first shielding member having an opening for said corona discharge and an opening for discharging produced ozone, said first shielding member being provided so as to surround said corona discharge wire;

an electrically insulating member being mounted across said opening for discharging the produced ozone and being fixed at said first shielding member;

a second shielding member being fixed at said insulating member; and electric potential setting means for setting respective electric potentials of said first shielding member and said second shielding member so as to be different from each other.

21. The corona discharger as claimed in claim 20, wherein an opening for discharging the produced ozone is formed in said insulating member.

22. The corona discharger as claimed in claim 20, wherein said electric potential setting means sets respective electric potentials of said side plate and said back plate so that a difference between respective electric potentials of said first member and said discharge member becomes smaller than a difference between said second member and said discharge member.

23. The corona discharge as claimed in claim 20, wherein said second member is located at a predetermined position so that an electric field induced between said second member and said discharge member becomes higher than an electric field induced between said discharge member and said member to be electrified.

* * * * *